US007040876B2

(12) United States Patent
Fukami et al.

(10) Patent No.: US 7,040,876 B2
(45) Date of Patent: May 9, 2006

(54) VALVES FOR A DIAPHRAGM PUMP

(75) Inventors: Tadashi Fukami, Inagi (JP); Koji Onishi, Saku (JP); Goro Kakizawa, Inagi (JP); Koichi Nakatsugi, Inagi (JP)

(73) Assignee: Oken Seiko Co., Ltd., Tokyo (JP)

( * ) Notice: Subject to any disclaimer, the term of this patent is extended or adjusted under 35 U.S.C. 154(b) by 0 days.

(21) Appl. No.: 11/011,279

(22) Filed: Dec. 15, 2004

(65) Prior Publication Data

US 2005/0169780 A1 Aug. 4, 2005

Related U.S. Application Data

(62) Division of application No. 10/287,525, filed on Nov. 5, 2002, now Pat. No. 6,843,643.

(30) Foreign Application Priority Data

| | | |
|---|---|---|
| Nov. 6, 2001 | (JP) | 2001-340096 |
| Jan. 24, 2002 | (JP) | 2002-15418 |
| Jan. 29, 2002 | (JP) | 2002-19900 |
| Mar. 11, 2002 | (JP) | 2002-64661 |
| Apr. 17, 2002 | (JP) | 2002-114966 |
| May 16, 2002 | (JP) | 2002-140833 |
| May 27, 2002 | (JP) | 2002-152448 |

(51) Int. Cl.
*F04B 17/00* (2006.01)

(52) U.S. Cl. ..... 417/413.1; 417/531; 417/566

(58) Field of Classification Search ..... 417/413.1, 417/560, 566, 571, 531
See application file for complete search history.

(56) References Cited

U.S. PATENT DOCUMENTS

| | | | | |
|---|---|---|---|---|
| 155,667 | A | 10/1874 | Painter | |
| 943,996 | A | 12/1909 | Reineking | |
| 4,545,735 | A | 10/1985 | Ims | |
| 4,801,249 | A * | 1/1989 | Kakizawa | 417/269 |
| 4,832,582 | A * | 5/1989 | Buffet | 417/413.1 |
| 4,874,299 | A | 10/1989 | Lopez et al. | |
| 5,192,200 | A | 3/1993 | Lilie et al. | |
| 5,275,541 | A | 1/1994 | Becker et al. | |
| 5,332,370 | A | 7/1994 | Nakayama et al. | |
| 5,785,508 | A | 7/1998 | Bolt | |
| 5,803,122 | A * | 9/1998 | Theilmeier | 137/854 |
| 6,047,698 | A | 4/2000 | Magidson et al. | |
| 6,082,979 | A * | 7/2000 | Friedman | 417/566 |
| 6,264,438 | B1 * | 7/2001 | Fukami | 417/412 |
| 6,364,636 | B1 | 4/2002 | Chang | |
| 6,382,928 | B1 | 5/2002 | Chang | |

FOREIGN PATENT DOCUMENTS

| | | |
|---|---|---|
| JP | 62-267585 | 11/1987 |
| JP | 62-291484 | 12/1987 |
| JP | 63-67682 | 5/1988 |
| JP | 06249149 | 9/1994 |

(Continued)

*Primary Examiner*—Charles G. Freay
(74) *Attorney, Agent, or Firm*—Finnegan, Henderson, Farabow, Garrett & Dunner, L.L.P.

(57) ABSTRACT

A pump which has a diaphragm main body integrally connected at a planar portion to a diaphragm portion forming a pump chamber and performs a pumping action by reciprocating a driving portion disposed integrally with the diaphragm portion; the pump being configured compact by disposing a suction valve at the planar portion of the diaphragm main body and further using a planar discharge valve.

11 Claims, 24 Drawing Sheets

FOREIGN PATENT DOCUMENTS

| | | |
|---|---|---|
| JP | 07293450 | 11/1995 |
| JP | 6-2665 | 1/1997 |
| JP | 3071468 | 6/2000 |
| JP | 3078480 | 4/2001 |
| TW | 387509 | 5/1988 |
| TW | 448981 | * 10/2000 |

* cited by examiner

FIG. 23A-I
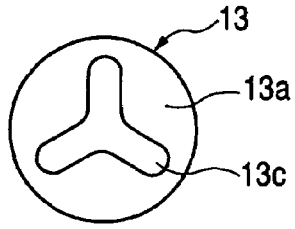
FIG. 23A-II
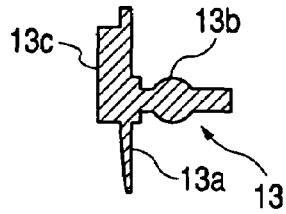
FIG. 23B-I
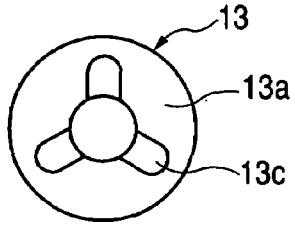
FIG. 23B-II
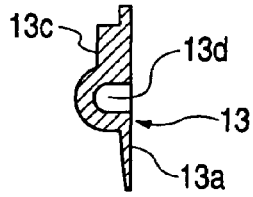
FIG. 23C-I
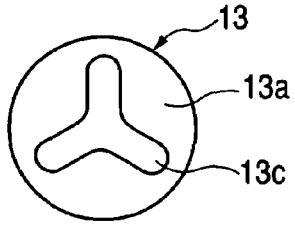
FIG. 23C-II
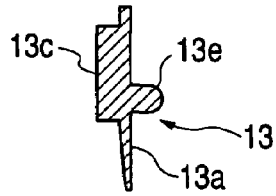
FIG. 23D-I
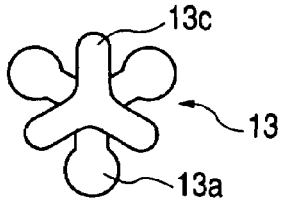
FIG. 23D-II
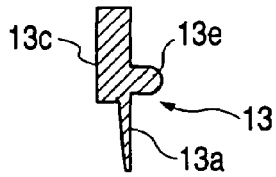
FIG. 23E-I
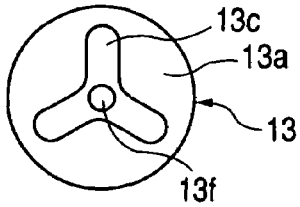
FIG. 23E-II
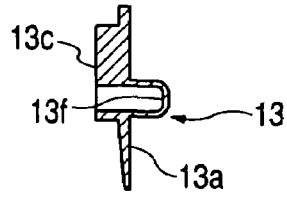

FIG. 23F-I
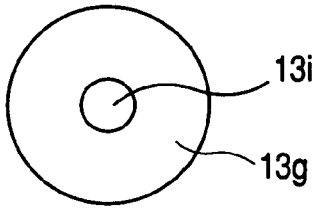
FIG. 23F-II
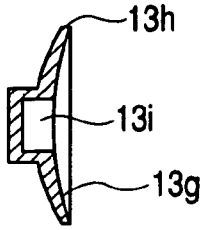
FIG. 23G-I
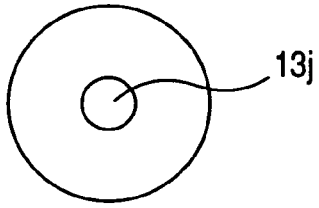
FIG. 23G-II
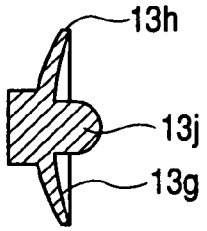
FIG. 23H-I
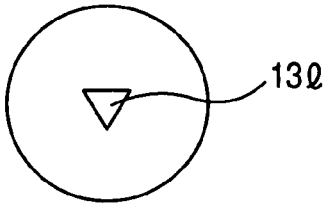
FIG. 23H-II
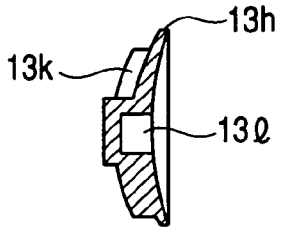
FIG. 23I-I
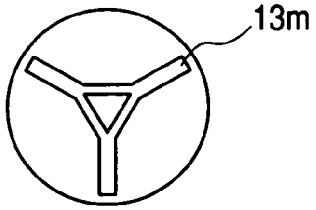
FIG. 23I-II
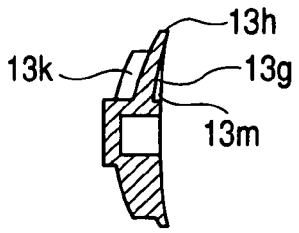

FIG. 24A-I
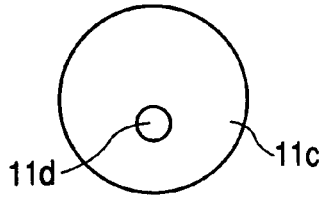
FIG. 24A-II
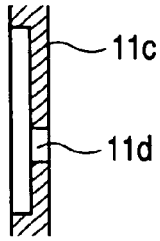
FIG. 24B-I
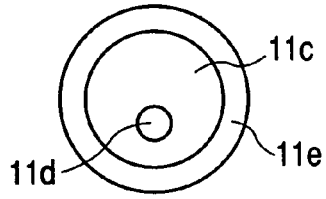
FIG. 24B-II
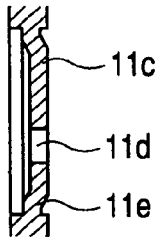
FIG. 24C-I
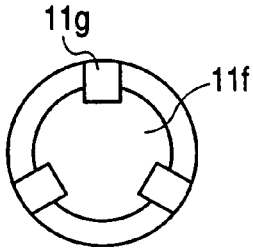
FIG. 24C-II
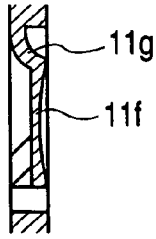
FIG. 24D-I
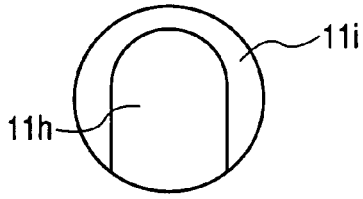
FIG. 24D-II
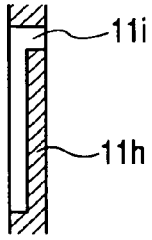
FIG. 24E-I
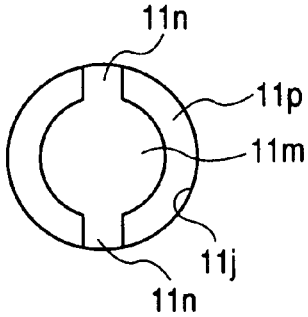
FIG. 24E-II
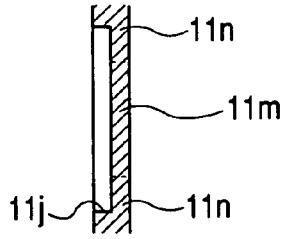

FIG. 24F-I
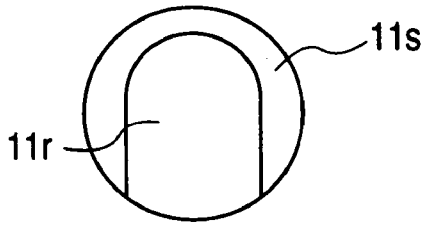
FIG. 24F-II
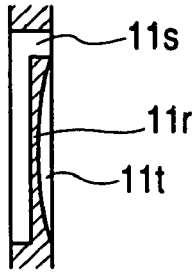
FIG. 24G-I
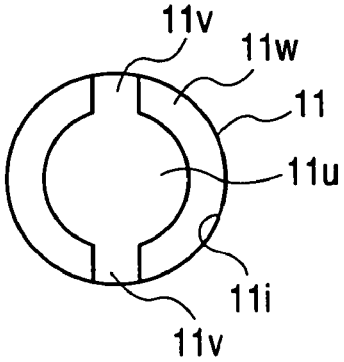
FIG. 24G-II
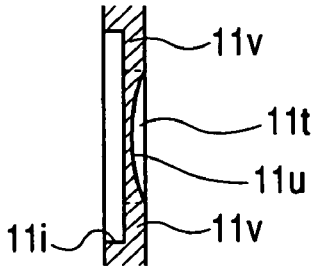
FIG. 24H-I
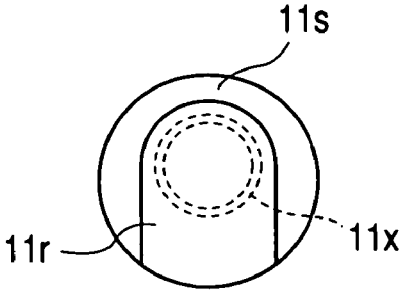
FIG. 24H-II
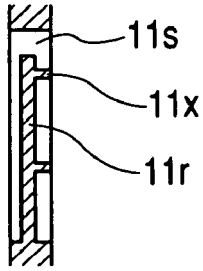

VALVES FOR A DIAPHRAGM PUMP

This application is a divisional application of U.S. application Ser. No. 10/287,525, filed Nov. 5, 2002, now U.S. Pat. No. 6,843,643 which is incorporated herein by reference.

BACKGROUND OF THE INVENTION a) Field of the Invention

The present invention relates to a diaphragm pump.

b) Description of the Prior Art

A conventional diaphragm pump is configured as shown in FIG. 1. In this drawing, a reference numeral 21 represents a motor, a reference numeral 22 designates an output shaft of the motor 21, a reference numeral 23 denotes a crank base which is fixed to the output shaft 22, a reference numeral 24 represents a driving shaft which is fixed to the crank base 23 in an inclined condition, a reference numeral 26 designates a driving body which is rotatably attached to the driving shaft 24, a reference numeral 27 denotes a casing, a reference numeral 28 represents a cylinder member and a reference numeral 29 designates a valve housing. A reference numeral 31 represents a diaphragm member and a reference numeral 32 designates a cylindrical discharge valve; the diaphragm portion and the discharge valve 32 being integrated to compose a diaphragm main body 30. This diaphragm main body 30 is held by the cylinder member 28 and the valve housing 29. Furthermore, reference numerals 33 and 34 represent a valve chamber member (common chamber) and a discharge port which are formed integrally with the valve housing 29, a reference numeral 35 designates an air intake valve and a reference numeral 36 denotes an air intake port.

The diaphragm pump which has the above described configuration rotates the crank base 23 when the output shaft 22 is driven and rotated by the motor 21. Rotation of the crank base 23 changes a direction of inclination of the driving shaft 24 which is fixed to the crank base 23. Accordingly, a direction of inclination of the driving body 26 is also changed and a driving portion (piston) 31*a* of the diaphragm member 31 reciprocates, thereby performing a pumping action. When the driving portion 31*a* is raised like a diaphragm member on the right side in FIG. 1, a capacity of a pump chamber is reduced and a pressure is changed in this chamber, whereby the cylindrical discharge valve 32 is opened and a fluid is sent out of discharge port 34. When a driving portion is lowered like a left side diaphragm member, on the other hand, a capacity of a pump chamber for this diaphragm member is increased, whereby external fluid opens the air intake valve 35 and flows into the pump chamber.

The diaphragm pump performs a pumping action by changing capacities of the pump chambers as described above, thereby allowing the fluid to flow from outside into the pump chamber through the air intake valve, and then allowing the inflow fluid to open the discharge port and to be supplied from the discharge port.

Since the above described conventional diaphragm pump uses the cylindrical discharge valve which is formed integrally with the diaphragm member, a portion composing the valve chamber portion (common chamber) in which this cylindrical valve is disposed is similarly cylindrical, protrudes from a surface portion of a cover body, has a discharge port extending from an upper end surface of the valve chamber portion, and is used in a condition where a pipe or the like is connected to this discharge port for leading the fluid to a location of supply.

Since the conventional diaphragm pump protrudes outside from the above described cylindrical portion composing at least the valve chamber portion (common chamber), the conventional diaphragm pump is obliged to have a relatively large and stepped form. Accordingly, the diaphragm pump is limited in its location of installation in rare cases.

Furthermore, the conventional diaphragm pump which uses the cylindrical discharge valve has a defect that it allows the cylindrical discharge valve to be deformed during part custody, transportation and the like before assembling the pump after manufacturing the valve. Furthermore, the cylindrical valve is thin and therefore poses a problem associated with assembly that the pump required tedious works to insert the cylindrical valve into the valve chamber portion (common chamber) at a pump assembling stage and the like.

SUMMARY OF THE INVENTION

An object of the present invention is to provide a diaphragm pump comprising at least a diaphragm portion which forms a pump chamber, a diaphragm main body which has the diaphragm portion and planar plate portion formed integrally with the diaphragm portion, a suction valve which is formed on the planar plate portion of the diaphragm main body and a discharge valve in a shape of a planar plate, and configured to perform a pumping action by changing a capacity of the diaphragm portion.

Another object of the present invention is to provide a diaphragm pump comprising a plurality of diaphragm portions which form pump chambers, a diaphragm main body which comprises the diaphragm portions and planar plate portions formed integrally with the diaphragm portions, suction valves formed on the planar plate portions of the diaphragm main body and discharge valves in a shape of a planar plate formed in the vicinities of middles of the plurality of diaphragm portions, and configured to perform a pumping action by changing capacities of the diaphragm portions.

Still another object of the present invention is to provide a diaphragm pump comprising a diaphragm main body which has at least a diaphragm portion for forming a pump chamber, a valve housing which has a concavity having a V-shaped or U-shaped section and discharge valves which have a V-shaped or U-shaped section and are disposed in the concavity of the valve housing, and configured to perform a pumping action by changing a capacity of the diaphragm portion.

BRIEF DESCRIPTION OF THE DRAWINGS

FIGS. 23A-I, 23A-II, 23B-I, 23B-II, 23C-I, 23C-II, 23D-I, 23D-II, 23E-I, 23E-II, 23F-I, 23F-II, 23G-I, 23G-II, 23H-I, 23H-II, 23I-I and 23I-II are diagrams showing forms of discharge valves to be used in the diaphragm pumps according to the present invention;

FIGS. 24A-I, 24A-II, 24B-I, 24B-II, 24C-I, 24C-II, 24D-I, 24D-II, 24E-I, 24E-II, 24F-I, 24F-II, 24G-I, 24G-II, 24H-I and 24H-II are diagrams showing forms of suction valves to be used in the diaphragm pumps according to the present invention.

DETAILED DESCRIPTION OF THE PREFERRED EMBODIMENTS

Now, description will be made of the preferred embodiments of the diaphragm pump according to the present invention.

Figure 2:
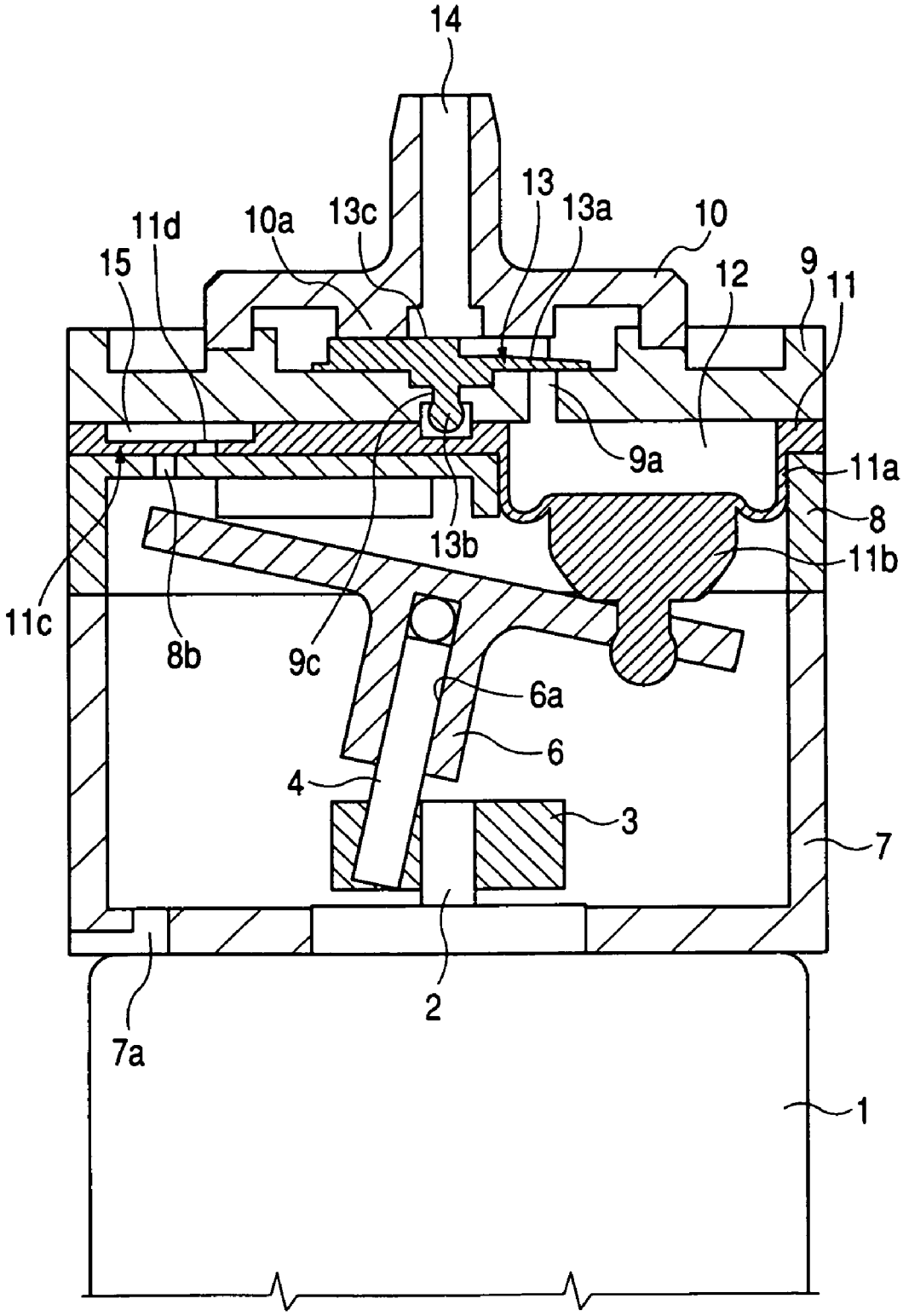
FIG. 2 is a sectional view showing a first embodiment of the present invention.

A configuration of a pump according to the first embodiment of the present invention is shown in FIG. 2, in which a reference numeral 1 represents a motor, a reference numeral 2 designates an output shaft of the motor 1, a reference numeral 3 denotes a crank base which is fixed to the output shaft 2, a reference numeral 4 represents a driving shaft which is fixed to the crank base 3 in a condition inclined relative to the output shaft 2, a reference numeral 6 designates a driving body which has a bearing portion 6*a* fitted over the driving shaft 4 to attach the driving body 6 rotatably to the driving shaft 4. A reference numeral 7 represents a case which has an air vent 7*a*, a reference numeral 8 designates a cylinder member, a reference numeral 9 denotes a valve housing, a reference numeral 10 represents an air collecting body, a reference numeral 11 designates a diaphragm main body which has a diaphragm portion 11*a* held by the cylinder member 8 and the valve housing, a reference numeral 12 denotes a pump chamber, a reference numeral 13 represents a discharge valve which is attached to the valve housing 9 and a reference numeral 14 designates a discharge port. The diaphragm pump according to the first embodiment of the present invention is assembled by combining the case 7, the cylinder member 8, the valve housing 9, the air collecting body 10, the discharge valve 13 and other parts as shown in FIG. 2.

Figure 3A:
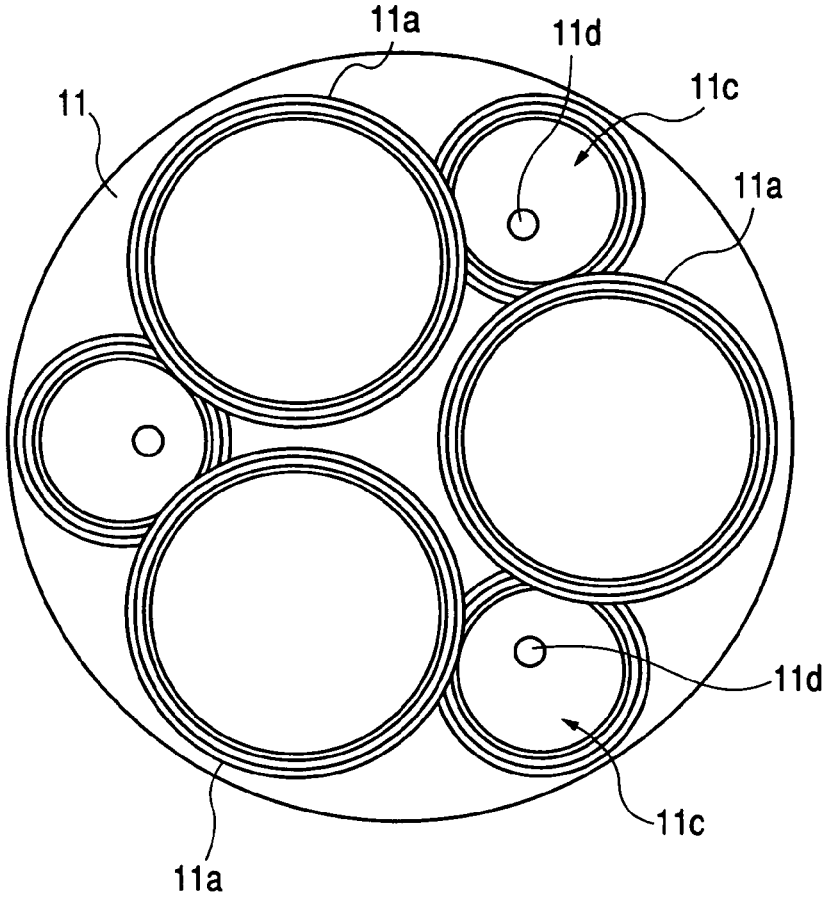
FIGS. 3A and 3B are diaphragms showing a configuration of a diaphragm main body according to the first embodiment.
Figure 3B:
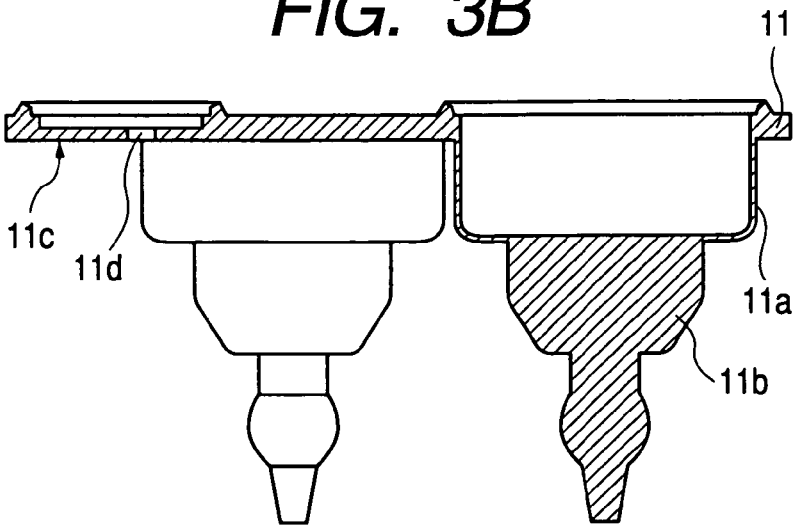
Figure 4A:
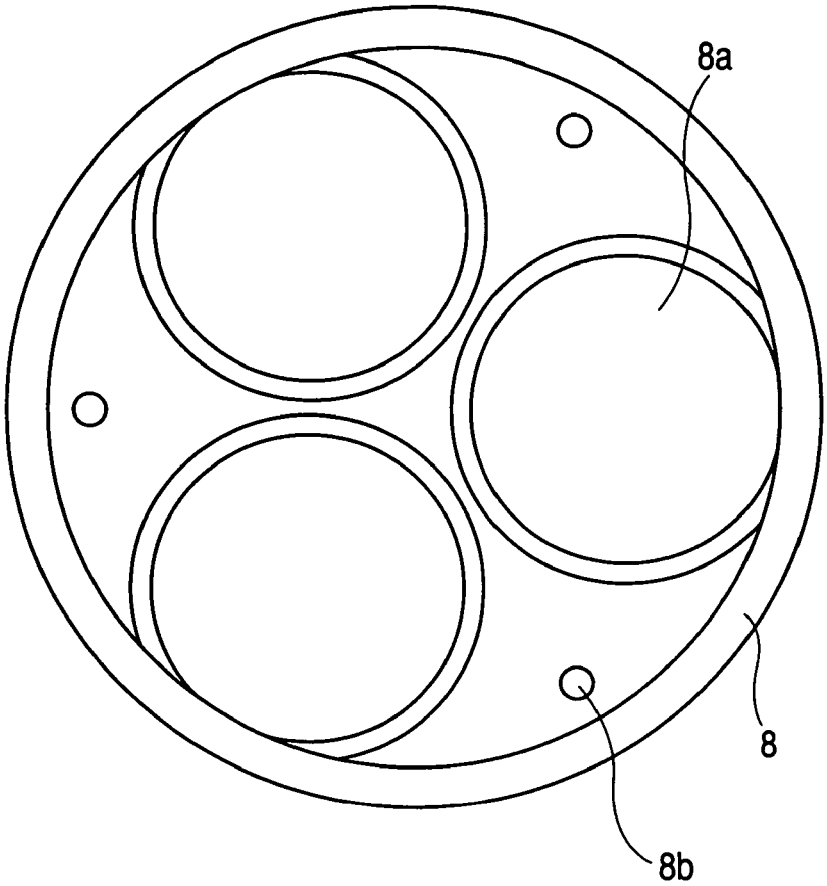
FIGS. 4A and 4B are diagrams showing a configuration of a cylinder member according to the first embodiment.
Figure 4B:
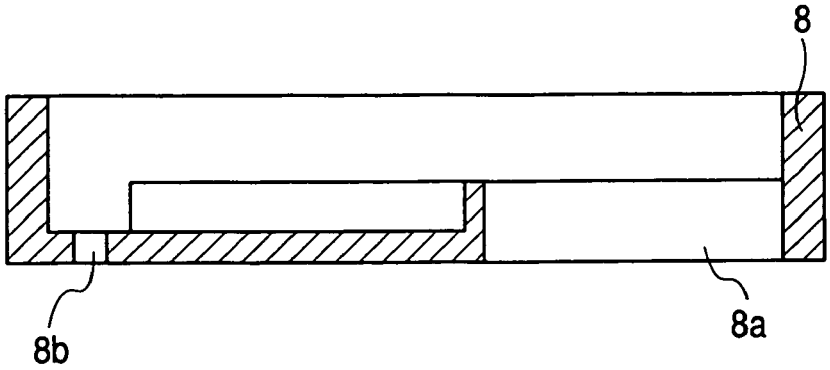
Figure 5:
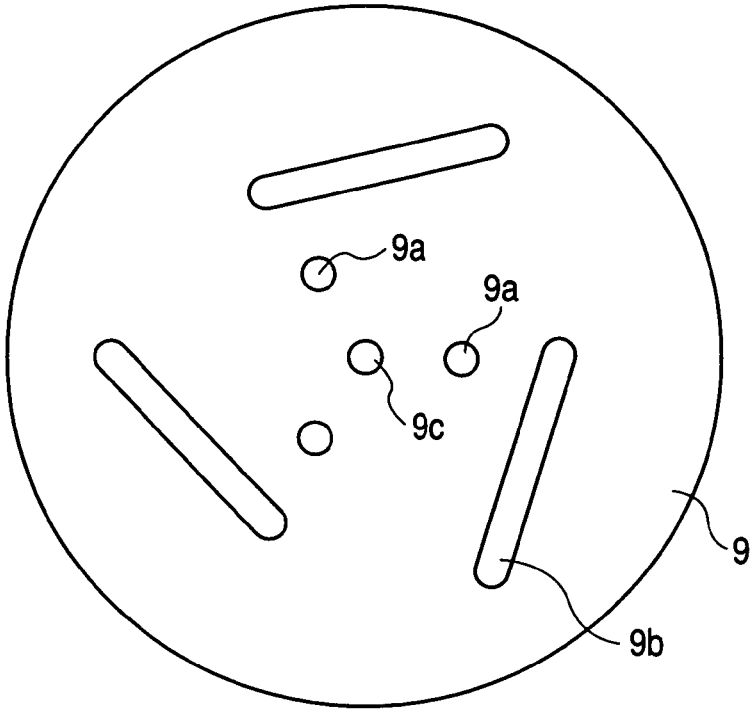
FIG. 5 is a bottom view of a valve housing according to the first embodiment.
Figure 6A:
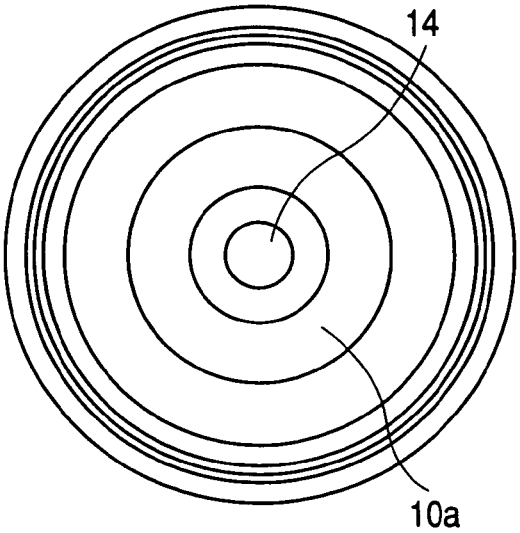
FIGS. 6A and 6B are diagrams showing a configuration of an air collecting body according to the first embodiment.
Figure 6B:
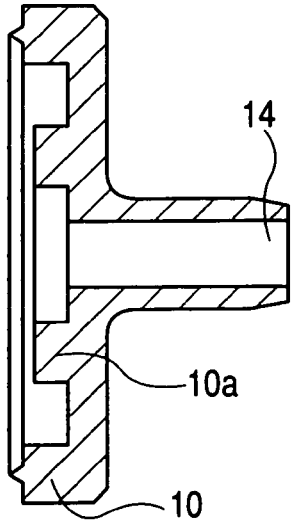

The valve housing 11 of the pump according to the first embodiment is configured as shown in FIGS. 3A and 3B; FIG. 3A being a plan view and FIG. 3B being a side view (sectional view). Furthermore, FIGS. 4A and 4B are diagrams showing a form of the cylinder member 8; FIG. 4A being a plan view and FIG. 4B being a sectional view. Furthermore, FIG. 5 is a plan view of the valve housing 9, whereas FIGS. 6A and 6B are diagrams showing the air collecting body; FIG. 6A being la bottom view and FIG. 6B being a sectional view. Furthermore, the discharge valve 13 which is used in the pump according to the first embodiment illustrated in FIG. 2 is configured as shown in FIGS. 23A-I and 23A-II.

The diaphragm pump according to the present invention consists of the above described diaphragm portion and the like which are assembled as shown in FIG. 2.

Now, each of the parts composing the diaphragm pump according to the first embodiment and an overall configuration of an assembled condition of the parts will be described in detail.

First, the diaphragm main body 11 is made of an elastic material such as rubber, and configured as shown in FIGS. 3A and 3B. That is, this diaphragm main body 11 consists of a plurality of diaphragm portions 11*a* (the diaphragm main body shown in FIG. 2 consists of three diaphragm portions arranged at equal intervals on a circumference as shown in the plan view presented as FIG. 3A), and three thin valve portions 11*c* in shapes of planar plates disposed among the diaphragm portions 11*a* and each having a hole 11*d*.

Furthermore, formed in the cylinder portion 8 is a hole (suction port) 8*b* between a cylinder 8*a* and a cylinder 8*a* in which the diaphragm portions 11*a* are to be disposed.

Furthermore, the valve housing 9 has a shape shown in FIG. 5. The valve housing 9 as seen from downside of FIG. 2 is shown in FIG. 5, in which a reference numeral 9*a* represent an air vent, a reference numeral 9*b* designates a groove and a reference numeral 9*c* denotes a valve mounting hole.

The cylinder member 8, the diaphragm main body 11 and the valve housing 9 which are described above are disposed so as to sandwich and hold the diaphragm main body 11 between the cylinder member 8 and the valve housing 9 as shown in FIG. 2.

The diaphragm pump according to the first embodiment of the present invention is configured to assemble the diaphragm main body 11 with the cylinder member 8 by inserting or disposing the diaphragm portion 11*a* into the cylinder 8*a* of the cylinder member 8. Furthermore, an assembly of the diaphragm main body 11 and the cylinder member 8 is attached to the case 7 of the cylinder member 8 for integration after a tip of the driving portion (piston) 11*b* which is assembled with the diaphragm portion 11*a* is fixed to a predetermined position of the driving body 6.

On the other hand, the discharge valve 13 is disposed in the valve housing 9 by pressing a mounting portion 13*b* of the discharge valve 13 into the valve mounting hole 9*c* of the valve housing 9. Furthermore, the air collecting body 10 is fixed to the valve housing 9, thereby assembling the valve housing 9 with the air collecting body 10 in a condition where the valve 13 is pressed and held by a valve clamp 10*a* of the air collecting body 10.

The pump is assembled as shown in FIG. 2 by fixing an assembly of the valve housing 9 and the air collecting body 10 to the cylinder member 8 so as to sandwich the diaphragm main body 11.

Now, description will be made of functions of the diaphragm pump according to the first embodiment.

Figure 1:
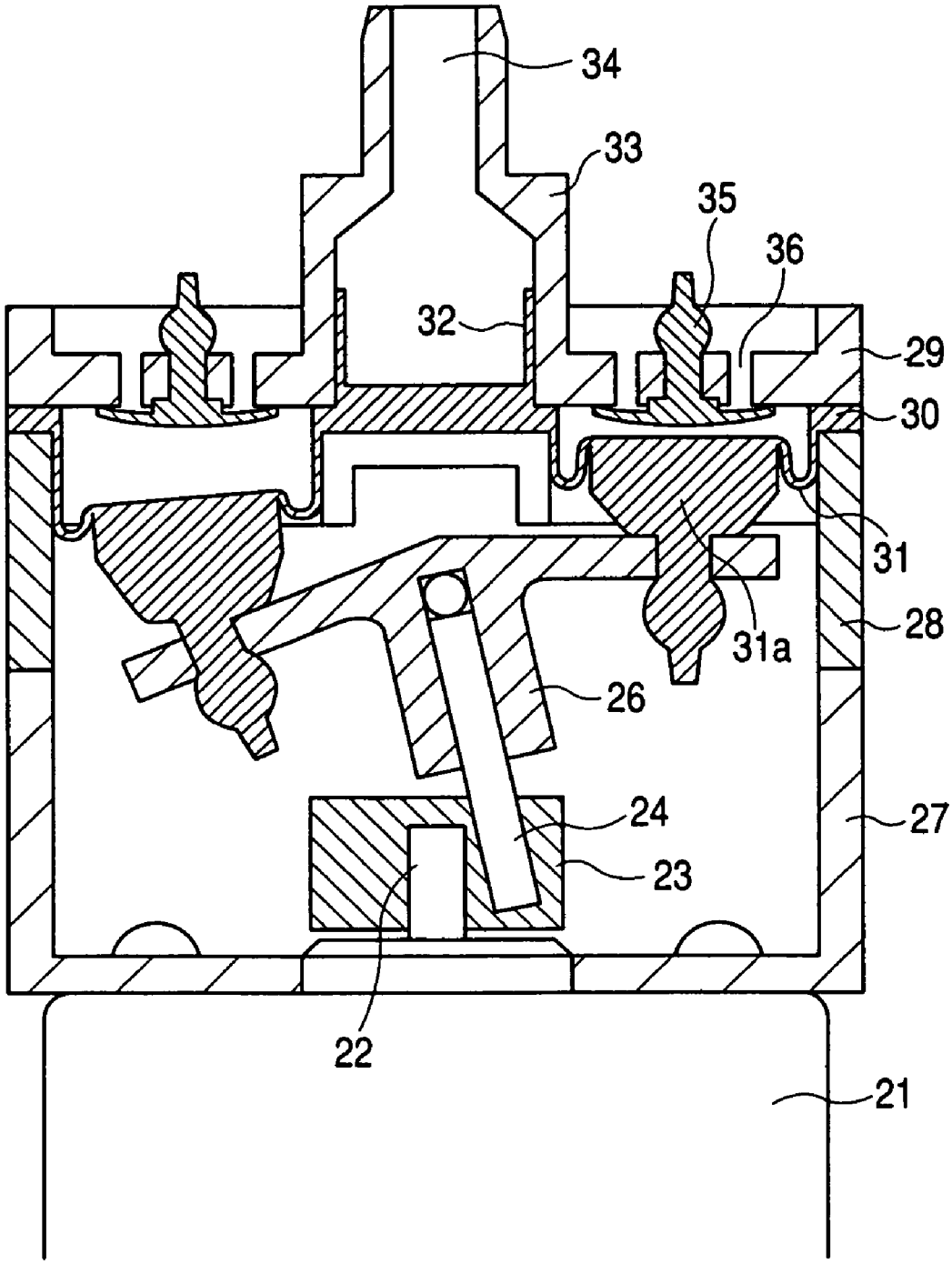
FIG. 1 PRIOR ART
FIG. 1 is a sectional view showing a conventional diaphragm pump.

When the motor 1 is driven, this diaphragm pump rotates the output shaft 2, thereby rotating the crank base 3 which is fixed to the output shaft 2. Accordingly, the diaphragm pump changes an angle of inclination of the driving shaft 4 and an angle of inclination of the driving body 6, thereby moving up and down a driving portion 11*b* of the diaphragm portion 11*a* like the conventional pump shown in FIG. 1.

When the driving portion 11*b* is moved up and down, a capacity of the pump chamber 12 is changed. When the driving portion 11*b* of the diaphragm portion 11*a* is raised higher than a position shown in FIG. 2, the capacity of the pump chamber 12 is reduced and a pressure is enhanced in the pump chamber, whereby the valve 13 (a valve portion 13*a* between ribs 13*c* shown in FIG. 23A-I) is opened, and a fluid which is reserved in the pump chamber 12 is supplied outside from the discharge port 14 while flowing through a gap between the ribs 13*c* as well as a gap between the air collecting body 10 shown in FIGS. 6A, 6B and the valve housing. At this time, discharge valves corresponding to the other diaphragm portions are kept closed.

When the driving portion 11*b* of the diaphragm portion 11*a* shown in FIG. 2 is lowered and the capacity of the pump chamber 12 is increased, the pressure is lowered in the pump chamber and the discharge valve 13 is closed. Reversely, the thin planar portion (suction valve) 11*c* of the diaphragm main body 11 is deformed toward a space 15 and opened, whereby a fluid which is reserved in the cylinder member 8 and the case 7 is flowed from the hole 8*b* into a gap formed between the diaphragm main body and the cylinder member 8, and further into the diaphragm portion through a small hole 11*d* and a groove 9*b* of the valve housing 9. At this time, a fluid flows from outside into the case 7 through the air vent 7*a* formed in the case 7.

This pump chamber repeats the above described operations to successively flow the liquid into and out of the pump chamber, thereby performing a pumping action.

The other diaphragm portions (pump chambers) which are not shown in FIG. 2 also perform pumping actions by repeating quite the same operations. Moreover, the diaphragm pump shown in FIG. 2 uses a driving mechanism which is configured as described above and continuously changes a direction of inclination of the driving body, thereby supplying the fluid nearly continuously by operating the diaphragm portions at a definite phase difference.

The diaphragm pump according to the first embodiment which is configured as described above uses both the suction valve and the discharge valve each consisting of a plurality of valves which are integrated with one another, a small number of parts and the discharge valve which is configured as a planar valve. Accordingly, this pump is capable of using an air collecting body which is nearly planar in place of the cylindrical portion which composes the common chamber of the conventional diaphragm pump shown in FIG. 1. As a result, the diaphragm pump shown in FIG. 2 has a nearly cylindrical form from the case 7 to the air collecting body 10, except the discharge port 14 which is disposed to connect a pipe or the like for supplying a fluid, and is allowed to have a small height and can be configured compact. Furthermore, the diaphragm pump can be assembled easily since the discharge valve 13 can be mounted easily by pressing or drawing the convex portion 13*b* into the hole 9*c* of the valve housing, and the diaphragm portion, the diaphragm main body and other parts can easily be fixed by combining them consecutively.

Now, description will be made of a second embodiment of the diaphragm pump according to the present invention.

Figure 7:
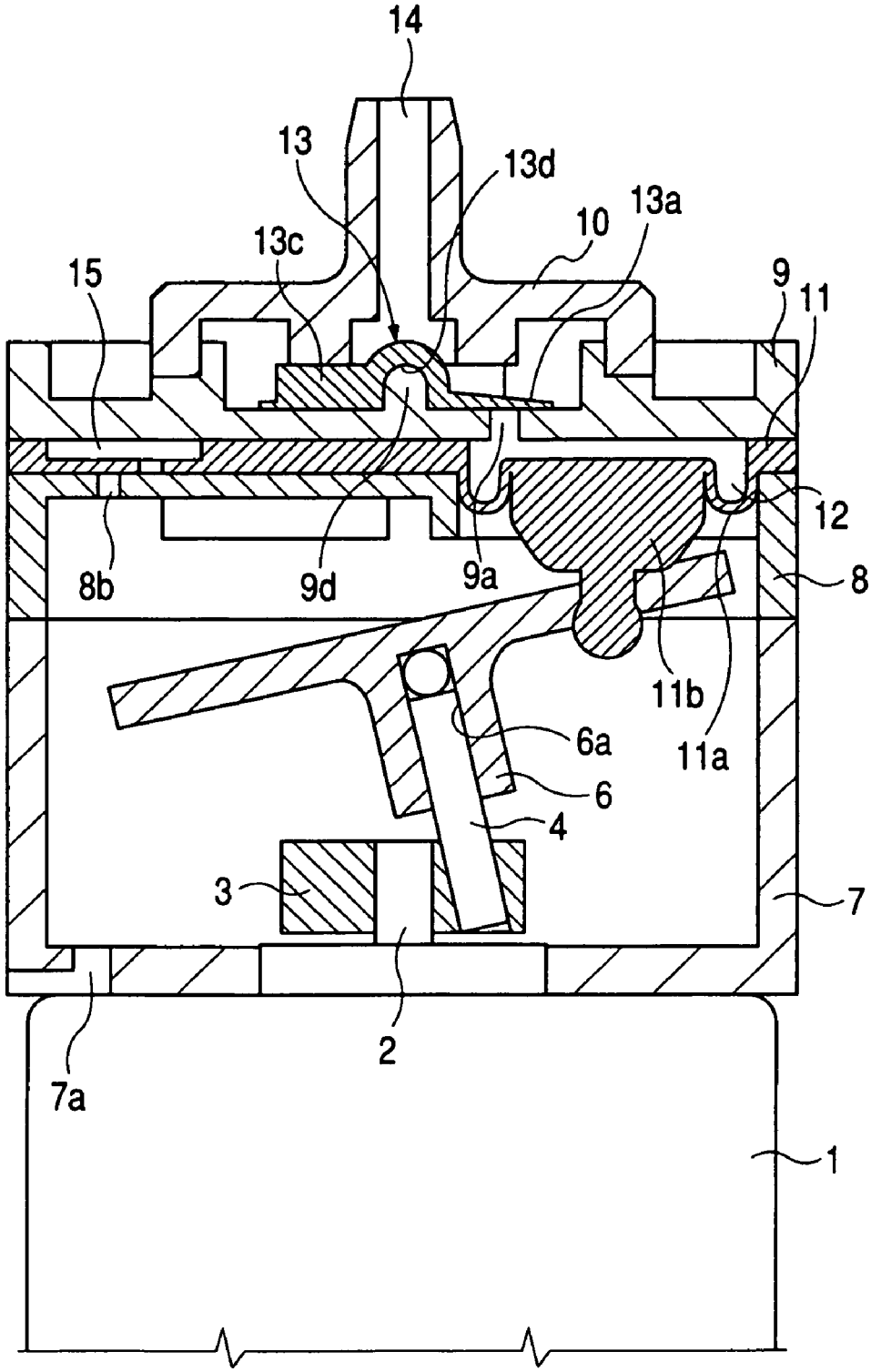
FIG. 7 is a sectional view showing a second embodiment of the present invention.

The second embodiment of the present invention is a diaphragm pump which is shown in FIG. 7 and uses a discharge valve configured as shown in FIGS. 23B-I and 23B-II. This discharge valve is configured in a form which has a concave portion (valve mounting concave portion) 13*d* formed at a center portion of the valve. On the other hand, a valve mounting convex portion 9*d* which is to fit into the concave portion 13*d* of the above described discharge valve is formed in a discharge port (on a side of an air collecting body) at a center of a valve housing as shown in FIGS. 3A and 3B so that the discharge valve is disposed so as to fit the concave portion 13*d* over the convex portion 9*d* and fixed by clamping a rib portion 13*c* with the air collecting body 10. The diaphragm pump according to the second embodiment has a configuration which is substantially the same in other respects as that of the diaphragm pump according to the first embodiment.

The diaphragm pump according to the first embodiment uses the discharge valve which is configured as shown in FIGS. 23A-I and 23A-II, whereas the diaphragm pump according to the second embodiment uses the diaphragm pump which is configured as shown in FIGS. 23B-I and 23B-II as described above.

Furthermore, it is conceivable to use, in addition to the above described discharge valves, those which are shown in FIGS. 23C-I, 23C-II, 23D-I, 23D-II, 23E-I, 23E-II and the like.

Out of these discharge valves, the discharge valve which is shown in FIGS. 23C-I and 23C-II is a valve formed to have a mounting convex portion 13*e* at a center of a bottom surface of the discharge valve. For use of this valve, it is sufficient to form at a center area of a valve housing a concave portion which is to fit over the convex portion of the valve, fit the convex portion of the valve into this concave portion and fix the valve by clamping the ribs with the air collecting body.

Furthermore, the discharge valve shown in FIGS. 23D-I and 23D-II which is similar to that shown in FIGS. 23C-I and 23C-II is configured so that a portion 13*a* of the valve has a minimum area required to have a function of a valve which closes an air vent so that the valve can be opened and closed easily. That is, the discharge valve shown in FIGS. 23D-I and 23D-II can be opened and closed with slight enhancement and reduction of a pressure in a pump chamber, and is usable, for example, in a more compact diaphragm pump.

In addition, the valves which are configured as shown in FIGS. 23A-I, 23A-II, 23B-I and 23B-II can be used in more compact pumps when valve portions are configured like a portion 13*a* of the valve shown in FIGS. 23D-I and 23D-II.

Any discharge valve which is to be used by the diaphragm pump according to the present invention has a rib 13*c* as shown in FIG. 23A-I, 23A-II, 23B-I, 23B-II, 23C-I, 23C-II, 23D-I, 23D-II, 23E-I or 23E-II. However, it is not always necessary to form the rib 13*c* on the discharge valve. In this case, it is sufficient to form a valve clamp on the air collecting body so that the discharge valve is clamped and held by a portion other than the valve portion 13*a* functioning as a valve.

FIGS. 23F-I, 23F-II, 23G-I, 23G-II, 23H-I, 23H-II, 23I-I and 23I-II are diagrams showing other discharge valves. Each of these valve has a surface which is concave as a whole on a side of the valve housing differently from the discharge valves which have been described above.

FIGS. 23F-I, 23G-I, 23H-I and 23I-I are diagrams as seen from bottoms (sides of the concave surfaces).

The discharge valves shown in FIGS. 23F-I and 23F-II has a simple structure having a bottom surface 13*g* which is concave as a whole as described above and a concave portion 13*i* at a center of a valve mounting surface.

This discharge valve is configured to fix and hold the valve by pressing the valve with a valve clamp of the air collecting body after the concave portion 13*i* is fitted over a valve mounting convex portion which is formed on the valve housing. This valve is used in a condition where a location other than an air vent (a position corresponding to the rib 13*c* in FIG. 23A-I or the like) is pressed by the valve clamp of the air collecting body, thereby keeping the bottom surface of the valve in close contact with the valve housing.

The valve shown in FIGS. 23F-I and 23F-II has a concave surface 13*g* which is a spherical surface. However, this concave surface is not limited to the spherical surface and may have another shape which is, for example, a shape of a curved surface close to the spherical surface or a surface of a circular cone. That is, the valve may have a section in a shape other than an arc shape and close to the arc shape, a triangular shape or the like. Anyway, the discharge valve is configured so as to be brought into close contact with the valve housing at least radially between the air vents of the valve housing, thereby shielding each air vent from the other air vents when the valve is pressed with the valve clamp. It is sufficient so far as the valve is configured to have shapes of the concave surface and the valve clamp which bring a circumference 13*h* of the valve is brought as a whole into close contact with the valve housing 9 when the valve is pressed.

The valve shown in FIGS. 23G-I and 23G-II is different from the discharge valve shown in FIGS. 23F-I and 23F-II in that the valve shown in FIGS. 23G-I and 23G-II has a convex portion 13*j* formed at a center portion of a concave surface 13*g*.

In other words, the valve shown in FIGS. 23G-I and 23G-II is disposed in the valve housing so that the convex portion 13*j* is fit into a concave portion formed at a position of the valve housing which corresponds to the convex portion 13*j*.

By pressing a valve 13 to the valve housing with a valve clamp, the concave surface 13*g* of the valve 13 is brought into close contact with a surface of the valve housing.

Like the valve shown in FIGS. 23F-I and 23F-II, the valve shown in FIGS. 23G-I and 23G-II can therefore be closed sufficiently under a low pressure.

The valve shown in FIGS. 23H-I and 23H-II is has a configuration in which a rib 13*k* is formed between valve portions functioning as valves and bring a concave surface into close contact, for example, with a surface of the valve housing by pressing the rib 13*k* with a valve clamp of the air collecting body.

Since the valve shown in FIGS. 23H-I and 23H-II is configured to press the rib 13*k* with the valve clamp, an opposite side of the rib 13*k* is always kept in close contact with the valve housing or the like. The portion 13*k* is always kept in close contact and airtight even when a circumferential portion 13*h* is opened due to deformation of a valve portion which is cause by a fluid flowing through an air vent. A section between the air vents is always kept in close contact and each air vent is partitioned in a sealed condition.

Since the opposite side of the rib 13*k* is always kept in close contact with the valve housing or the like in a valve 13 shown in FIGS. 23H-I and 23H-II, it is not preferable for this valve to locate the air vent on the opposite side or in the vicinity of the opposite side.

This valve therefore requires positioning.

The valve shown in FIGS. 23H-I and 23H-II is an example of discharge valve which is to be used in a diaphragm pump having three diaphragm portions (pump chambers), and has three valve portions and a triangular convex portion 131 for positioning. Formed on a valve housing is a triangular convex portion which is to be fitted into the triangular concave portion 131 of the valve 13 for positioning.

The valve shown in FIGS. 23I-I and 23I-II is configured to have a rib 13*k* like the valve shown in FIGS. 23H-I and 23H-II. However, the valve shown in FIGS. 23I-I and 23I-II is characterized in that a rib 13*m* is formed also on a concave surface 13*g*.

The rib 13*m* of this valve is formed at a position corresponding to the rib 13*k* but has a relatively small height. The rib 13*m* formed on the inside concave surface serves for bringing at least an inside surface of the valve into close contact with a surface of the valve housing when the valve is pressed with a valve clamp. When the rib 13*k* is pressed, the concave surface 13*g* of the valve 13 is brought close to the surface of the valve housing and a circumferential portion 13*h* of the valve 13 is brought into close contact, whereby the valve 13 operates under a low pressure.

The valve shown in FIGS. 23I-I and 23I-II must be configured so that the circumferential portion 13*h* of the valve is brought into close contact as described above when the valve is pressured. Therefore, it is not preferable for the valve to have the rib 13*m* which is too high (thick). In order to configure the valve so as to allow the circumferential portion 13*h* of the valve to be brought into close contact with the diaphragm portion when the valve is pressed, it is preferable to configure the rib 13*m* so as to extend inside the circumferential portion 13*h* as shown in FIGS. 23I-I and 23I-II. When the rib 13*m* is configured as described above, the air vents are partitioned by the rib 13*m* and the circumferential portion 13*h* outside the rib 13*m* is brought as a whole into close contact with the valve housing when the valve is pressed. Accordingly, the valve is closed when a pressure is not applied to the valve from a fluid coming from the pump chamber. When a pressure is enhanced in the pump chamber, the circumferential portion 13*h* is opened by a pressure applied through the air vent corresponding to the pump chamber, thereby allowing the fluid to flow to the discharge port. Since the rib 13*m* is kept in close contact with the valve housing 9 at this time, the other air vents are partitioned in an airtight condition and no influence is produced on the other pump chambers.

Though each of the valves shown in FIGS. 23G-I, 23G-II, 23H-I, 23H-II, 23I-I and 23I-II has the concave portion 13*g* having a shape of a spherical surface like the valve shown in FIGS. 23F-I and 23F-II, the concave portion 13*g* is not limited to the spherical surface and may be a curved surface close to the spherical surface or a concave surface having a shape of a circular cone. That is, it is sufficient for the valve to have a form which allows the valve to be brought into close contact with the valve housing among the air vents of the valve housing to partition the air vents in an airtight condition and at the circumferential portion 13*h* when the valve is pressed by the valve clamp.

Furthermore, each of the valves shown in FIGS. 23H-I, 23H-II, 23I-I and 23I-II has the rib 13*k*. The valve clamp of the air collecting body is therefore a valve clamp having a ring form and the object of the present invention can be accomplished by pressing the rib 13*k*.

Then, it is conceivable to use, in addition to those according to the above described first and second embodiments, suction valves having various forms in the diaphragm pump according to the present invention. That is, it is conceivable to use suction valves shown in FIGS. 24A-I, 24A-II, 24B-I, 24B-II, 24C-I, 24C-II, 24D-I, 24D-II, 24E-I and 24E-II. Out of these drawings, FIGS. 24A-I and 24A-II show the suction valve which is used in the embodiment illustrated in FIG. 2, whereas FIGS. 24B-I, 24B-II, 24C-I, 24C-II, 24D-I, 24D-II, 24E-I and 24E-II show suction valves which have different forms. Out of these drawings, all of FIGS. 24B-I, 24C-I, 24D-I and 24E-I are plan views, whereas all of FIGS. 24B-II, 24C-II, 24D-II and 24E-II are sectional views.

Out of these suction valves, the valve shown in FIGS. 24A-I and 24A-II is the valve which is used in the pump shown in FIG. 2 as described above and has a thin circular portion 11*c* formed between diaphragm portion as well as a small hole 11*d* formed at a location not to be overlapped with the air vent so that the thin circular portion 11*c* is easily deformable and functions as a valve.

Furthermore, the suction valve shown in FIGS. 24B-I and 24B-II is configured to be easily deformable by forming a ring-like slant portion 11*e* along a circumference of a thin circular portion 11*c*. A small hole 11*d* is formed also in this valve at a location similar to that of the valve shown in FIGS. 24A-I and 24A-II.

The suction valve which is shown in FIGS. 24C-I and 24C-II has a configuration in which a thin circular portion 11*f* composing a valve is held by a plurality of holding portions (three holding portions in FIG. 24C-I) 11*g* having a definite width and this thin portion 11*f* closes an air vent formed in the cylinder section, whereby a gap is formed along a circumference of the thin portion and it is unnecessary to form a small hole.

Furthermore, the valve shown in FIGS. 24D-I and 24D-II has a circular opening 11*i* and a tongue-like thin portion 11*h* for closing the air vent in a cylinder portion which are formed at a planar portion of the diaphragm main body 11 so that the tongue-like thin portion functions as a valve. Also for this example which forms a gap between the opening and the tongue-like thin portion, it is unnecessary to form a small hole.

Moreover, the valve shown in FIGS. 24E-I and 24E-II consists of a circular opening 11*j*, an air vent closing circular portion 11*m* having a diameter smaller than that of the opening 11*j*, and a thin portion composed of a holding portion 11*n* extending in a vertical direction in the drawings which are formed at a planar portion of the diaphragm main body 11. In addition, a reference numeral 11*p* represents an arc-like opening which is formed between the opening 11*j* and thin portion 11*m* composing a valve.

The thin circular portion 11*m* having the small diameter of this suction valve composes a valve for closing the air vent. When the thin circular portion 11 m having the small diameter is apart from a topside surface of the cylinder member 8 to open the air vent, a fluid which flows from the air vent comes into a concave portion through the circular opening 11*j*, passes through the groove 9*b* of the valve housing 9 and flows into the diaphragm portion 11 a. It is therefore unnecessary to form the hole 11*d* which is formed in the suction valve shown in FIGS. 24A-I and 24A-II or 24B-I and 24B-II.

A third embodiment which is described later is an example in which the suction valve shown in FIGS. 24E-I and 24B-II is used.

A suction valve which is shown in FIGS. 24F-I and 24F-II is a valve which has a tongue-like thin portion (valve portion) like the suction valve shown in FIGS. 24D-I and 24D-II. However, the suction valve shown in FIGS. 24F-I and 24F-II is different in that a surface-of the valve portion 11*r* which is on a side of the cylinder member (a right side surface in FIG. 24F-II) has a concave portion 11*t*.

Furthermore, a suction valve which is shown in FIGS. 24G-I and 24G-II has a valve portion 11*u* which is coupled with 11*v* at the planar portion of the diaphragm main body like the suction valve shown in FIGS. 24E-I and 24E-II. The valve shown in FIGS. 24G-I and 24G-II also has a concave portion formed in a surface of the valve portion 11*u* on the side of the cylinder member.

Moreover, a suction valve which is shown in FIGS. 24H-I and 24H-II uses a planar surface as a surface of a tongue-like valve portion 11*r* on the side of the cylinder member (a right side surface in FIG. 24H-II) and a convex portion 11*x* on a line surrounding a center of this surface.

Now, description will be made of a diaphragm pump according to a third embodiment of the present invention. The diaphragm pump according to the third embodiment has a configuration shown in FIG. 8 which is fundamentally the same as those of the pump according to the first and second embodiments. However, the diaphragm pump according to the third embodiment is different in a configuration of a suction valve 11*c*. The suction valve 11*c* of the third embodiment remains unchanged from those of the first and second embodiments in that the pump is disposed at a planar area of a diaphragm main body 11, but the suction valve itself is configured as shown in FIGS. 24E-I and 24E-II, therefore being different from those of the first and second embodiments.

Figure 8:
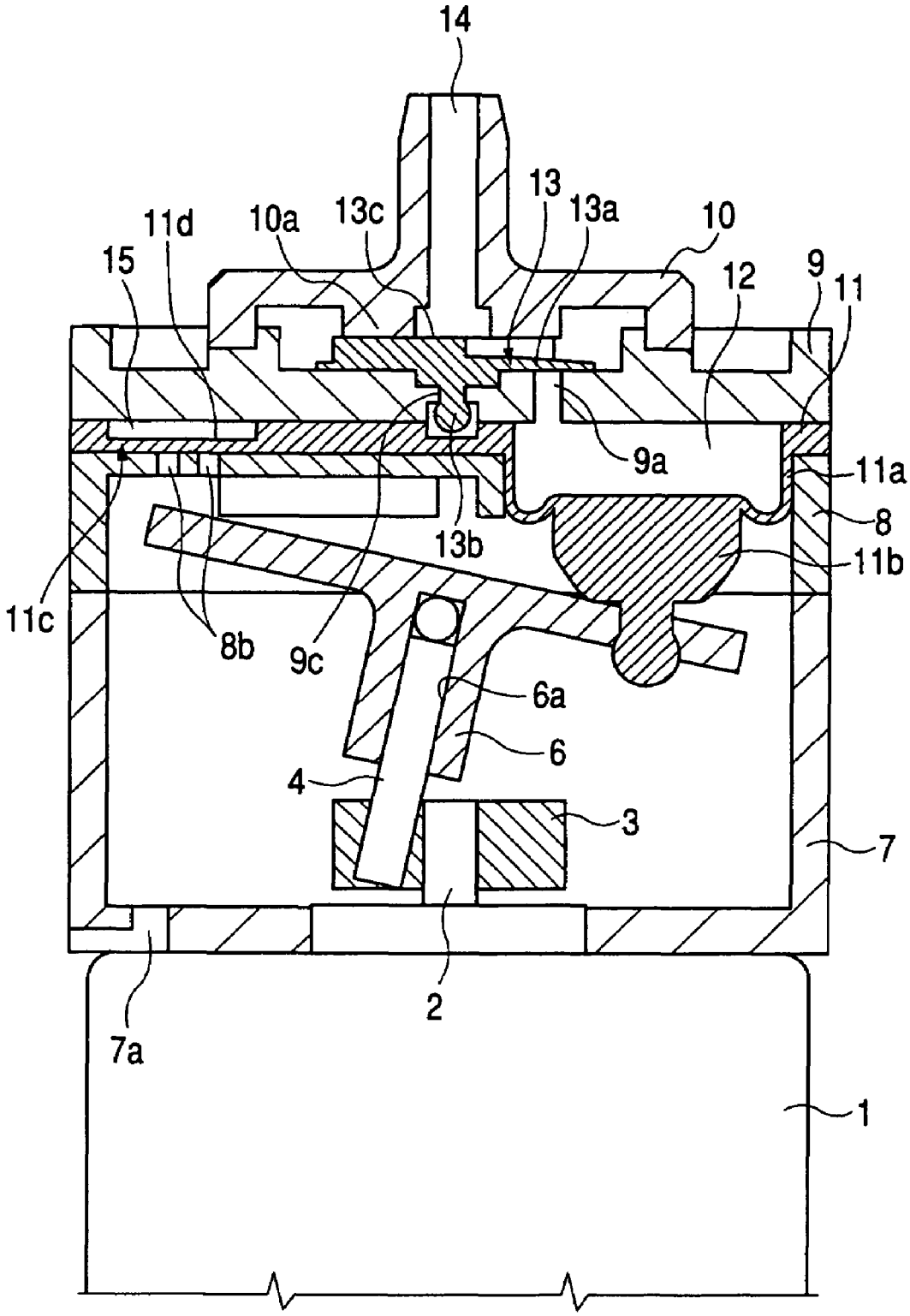
FIG. 8 is a sectional view showing a third embodiment of the present invention.
Figure 9A:
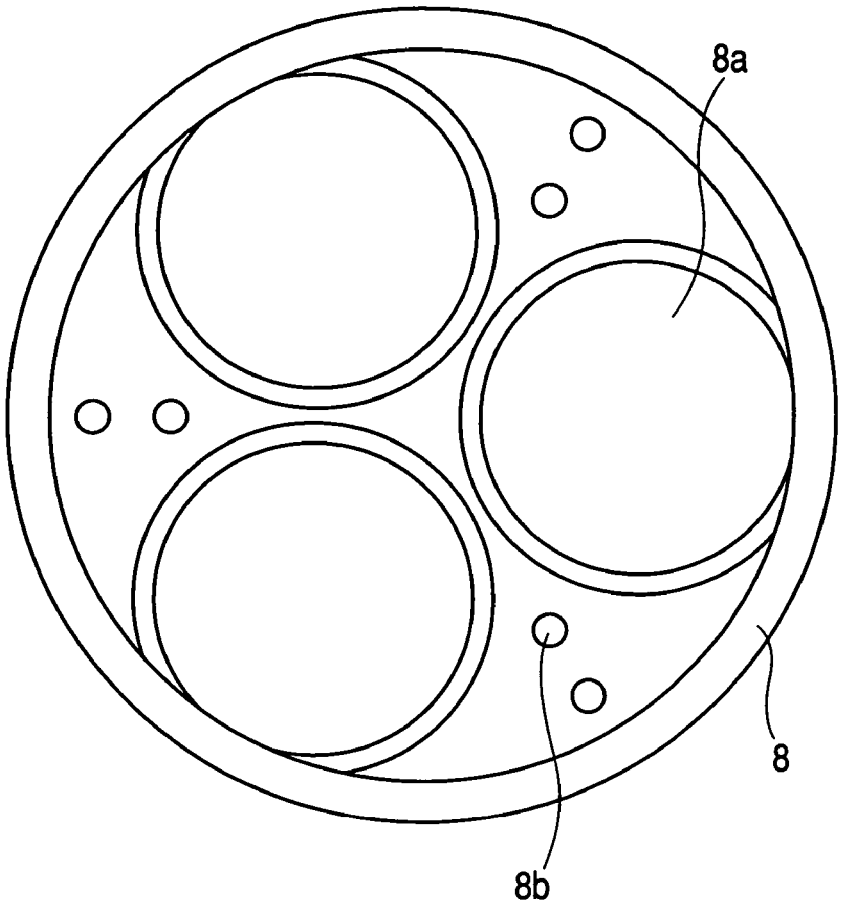
FIGS. 9A and 9B are diagrams showing a configuration of a cylinder member according to the third embodiment.
Figure 9B:
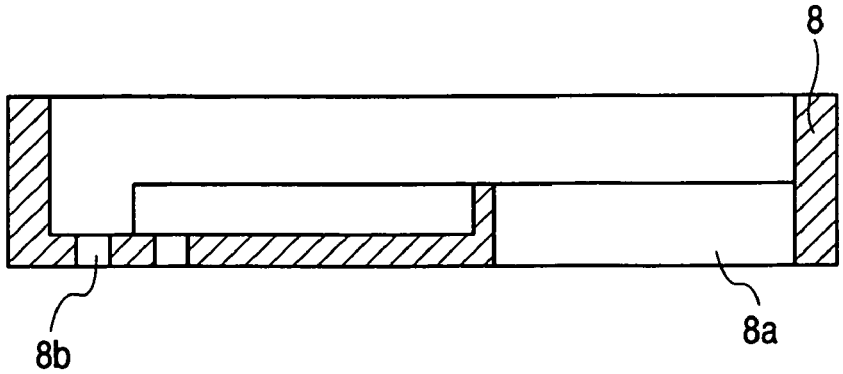

Furthermore, formed in a cylinder member 8 are two suction ports 8*b* for each suction valve as shown in FIGS. 8, 9A and 9B. In other words, it is unnecessary for the suction valve of the third embodiment to form the hole 11*d* unlike the section valve shown in FIGS. 24A-I and 24A-II. Therefore, it is unnecessary for the suction valve according to the third embodiment to form the hole 11*d* unlike the suction valve shown in FIGS. 24A-I and 24A-II. Accordingly, it is unnecessary for the diaphragm pump according to the third embodiment to shift a location of the suction port 8*b* to be formed in the cylinder member 8 so that the location is not overlapped with a hole as in a case where a valve having the hole 11*d* like the valve shown in FIGS. 24A-I and 24A-II is used. It is therefore preferable to locate the suction port 8*b* of the cylinder member 8 at a center of the suction valve 11*c*. Furthermore, two or more hole may be formed as in the pump according to the third embodiment.

Since the suction valve shown in FIGS. 24E-I and 24E-II which is used in the third embodiment has a form to be held by the holding portions 11*n*, the valve can be opened and closed easily the securely.

Figure 10A:
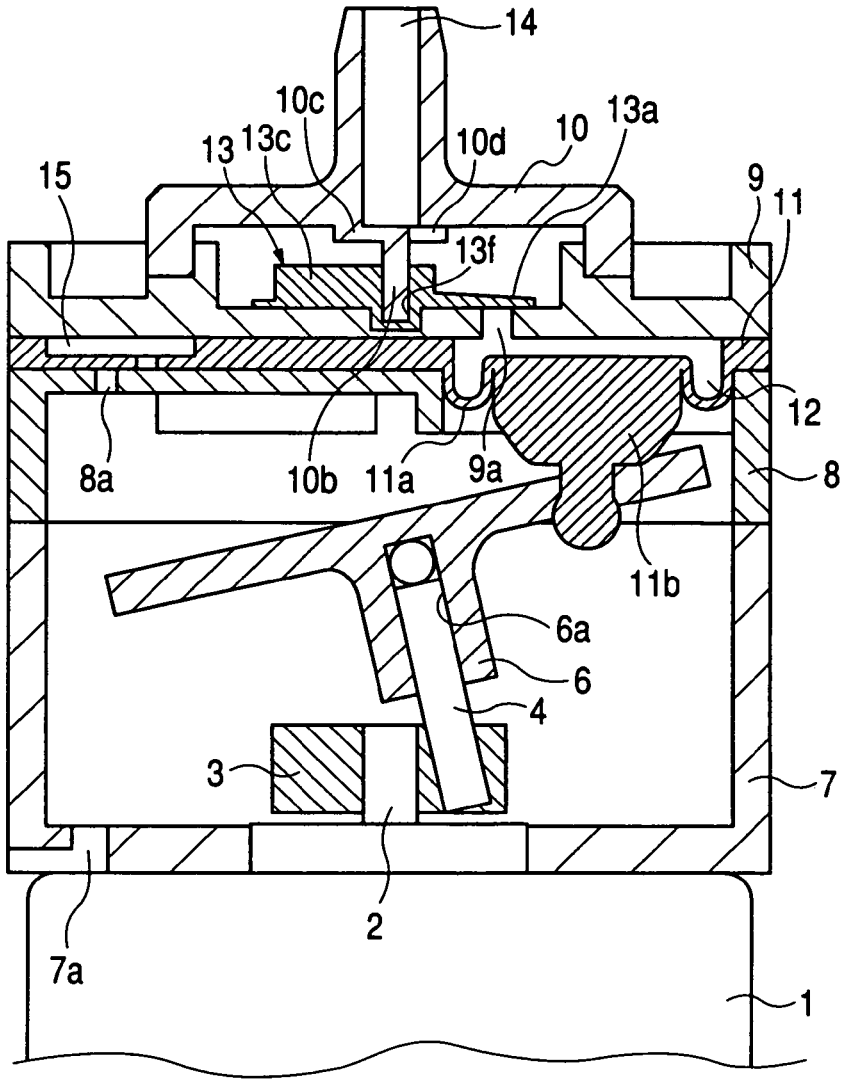
FIGS. 10A and 10B are diagrams showing a fourth embodiment of the present invention.
Figure 10B:
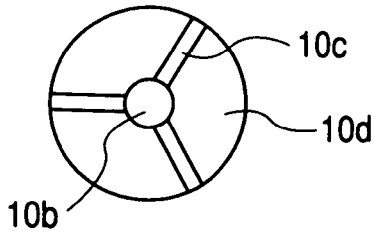

FIGS. 10A and 10B are diagrams illustrating a fourth embodiment of the present invention.

A diaphragm pump according to the fourth embodiment is different in a configuration of a discharge valve 13 from the diaphragm pumps according to first and second embodiments, but remains the same in other configurational respects.

Specifically speaking, the discharge valve 13 of the diaphragm pump according to the fourth embodiment has a fixing portion 13*f* which is formed at a center portion as shown in FIGS. 23E-I and 23E-II to press and fix the valve, three ribs 13*c* which are formed radially from the fixing portion 13*f*, and a thin portion between adjacent ribs 13*c* which composes a valve 13*a* corresponding to each pump chamber 12.

In the fourth embodiment, the discharge valve shown in FIGS. 23E-I and 23E-II has a valve clamp portion 10*b* which is formed at a center of an air collecting body 10 as shown in FIG. 10A in order to fix and hold the discharge valve 13 at a predetermined position by inserting the valve clamp portion into a concave portion composing the fixing portion 13*f*. This valve clamp portion 10*b* is supported by holding ribs 10*c* as shown in FIG. 10B on an enlarged scale and sections among the ribs 10*c* serve as air vents 10*d*.

The diaphragm pump according to the fourth embodiment securely holds and fixes the discharge valve 13 at the predetermined position owing to the valve clamp portion 10*b* which is formed on the air collecting body 10, and allows a fluid which flows from each pump chamber while opening the discharge valve 13 to be supplied outside with no hindrance at a pumping action time owing to the air vents 10*d* which are formed among the ribs 10*c*.

Fifth, sixth and seventh embodiments which are described below are different from the above described first, second, third and fourth embodiments in configurations of discharge valves and the like. Furthermore, the fifth, sixth and seventh embodiments use the valve shown in FIGS. 24E-I and 24E-II as a suction valve.

Figure 11:
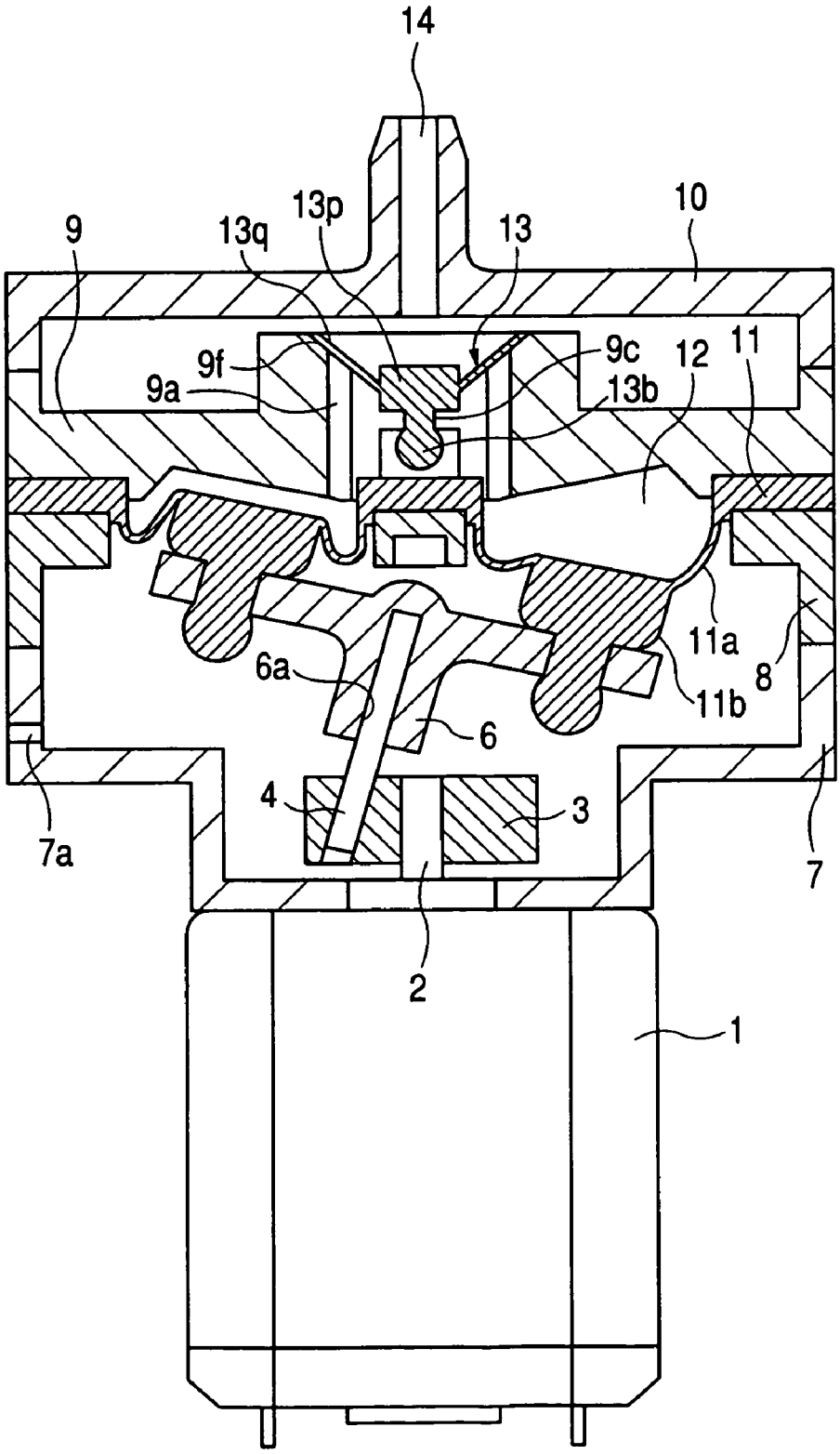
FIGS. 11 and 12 are diagrams showing a fifth embodiment of the present invention.
Figure 12:
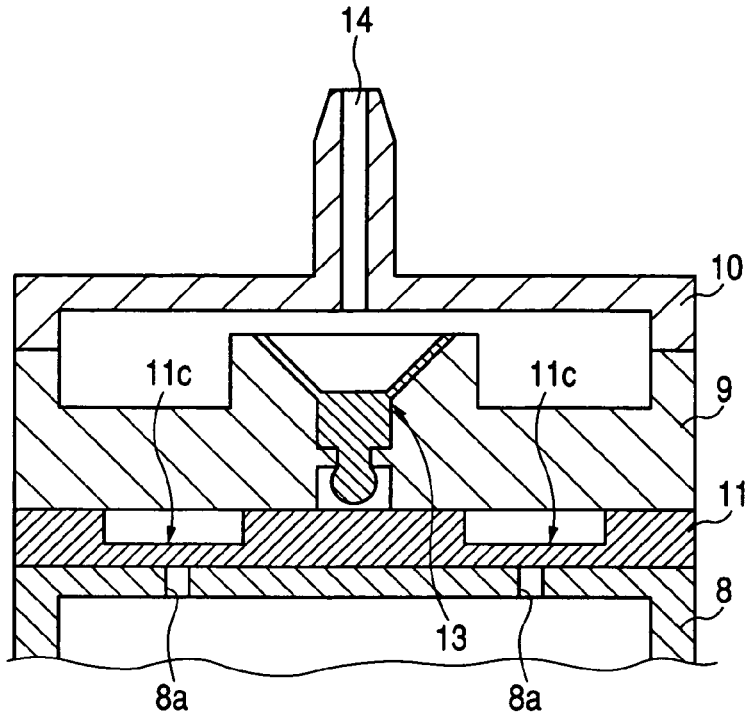

FIGS. 11 and 12 show a configuration of a diaphragm pump according to the fifth embodiment of the present invention: FIG. 11 being a sectional view and FIG. 12 being a sectional view taken in a direction perpendicular to the paper surface. In these drawings, a reference numeral 1 represents a motor, a reference numeral 2 designates an output shaft of the motor 1, a reference numeral 3 denotes a crank base which is fixed to the output shaft, a reference numeral 4 represents a driving shaft which is fixed to he crank base in a condition inclined relative to the output shaft 2 and a reference numeral 6 designates a/driving body which is rotatably attached to the driving shaft 4 by inserting the driving shaft 4 into a bearing portion 6*a* of the driving body 6. A reference numeral 7 represents a case having an air vent 7*a*, a reference numeral 8 designates a cylinder member, a reference numeral 9 denotes a valve housing, a reference numeral 10 represents an air collecting body, a reference numeral 11 designates a diaphragm main body having a diaphragm 11*a* which is held by the cylinder member 8 and the valve housing 9, a reference numeral 12 denotes a pump chamber, a reference numeral 13 represents a discharge valve having a V shaped section which is disposed in a concave portion 9*f* having a V-shaped section of the valve housing 9 and a reference numeral 14 designates a discharge port which is formed in the air collecting body 10.

For assembling the pump according to the fifth embodiment, a mounting portion (protrusion) 13*b* may be pressed into a mounting hole 9*c* by pressing the center portion 13*p* of the V-shaped valve 13 to the concave portion 9 having a V shaped section of the valve housing 9, but pump assembling works are practically made easier and more effective by a method which connects a string like member to a low point of the mounting portion (protrusion) 13*b*, pressing the mounting portion 13*b* by pulling the string like member downward and then disconnects the string-like member. This method fixes the air collecting body 10 to the valve housing 9 after pressing and fixing the discharge valve 13 to the valve housing 9. The pump shown in FIG. 11 is assembled by forming an assembly of the valve housing 9, the air collecting body 10 and the V-shaped discharge valve 13, and then combining and fixing this assembly with and to an assembly of the case 7, the cylinder 8, the diaphragm main body 11 and other parts as in the first embodiment.

The diaphragm pump according to the fifth embodiment is different from the diaphragm pumps according to the first, second, third and fourth embodiment in that the diaphragm pump according to the fifth embodiment uses the valve having the V-shaped section as the discharge valve. Furthermore, the fifth embodiment is different from the first, second, third and fourth embodiment in that the concave portion having the V-shaped section (conical concave portion) is formed in the valve housing to dispose the discharge valve having the V shaped section in the fifth embodiment. However, the fifth embodiment is fundamentally the same as these embodiments with respect to forms of the other parts. The fifth embodiment is the same in particular as the above described embodiment in that the fifth embodiment uses the valve shown in FIGS. 24E-I and 24E-II as the suction valve.

Figure 13:
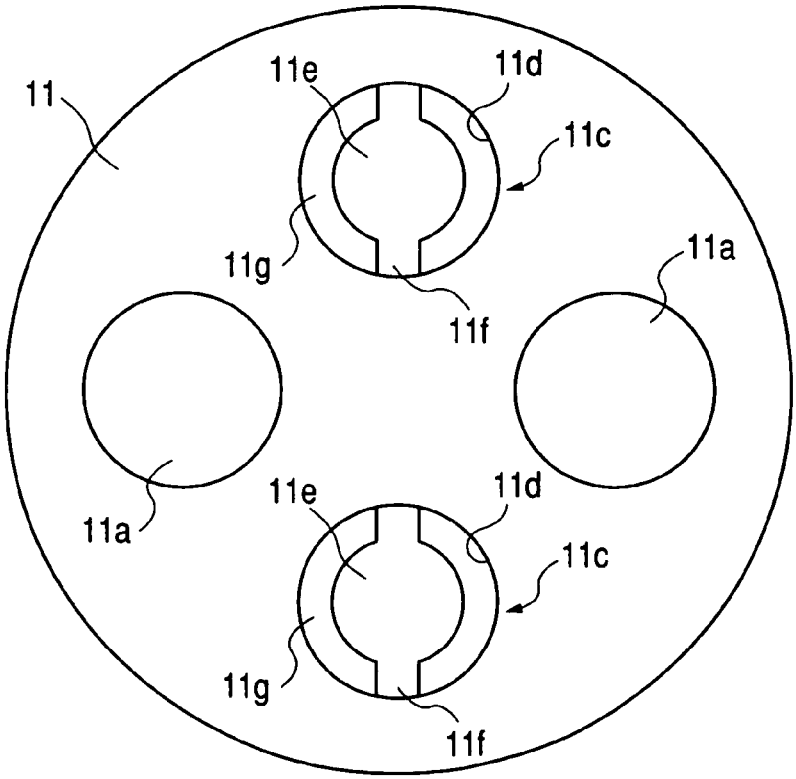
FIG. 13 is a plan view of a diaphragm portion according to the fifth embodiment.
Figure 14:
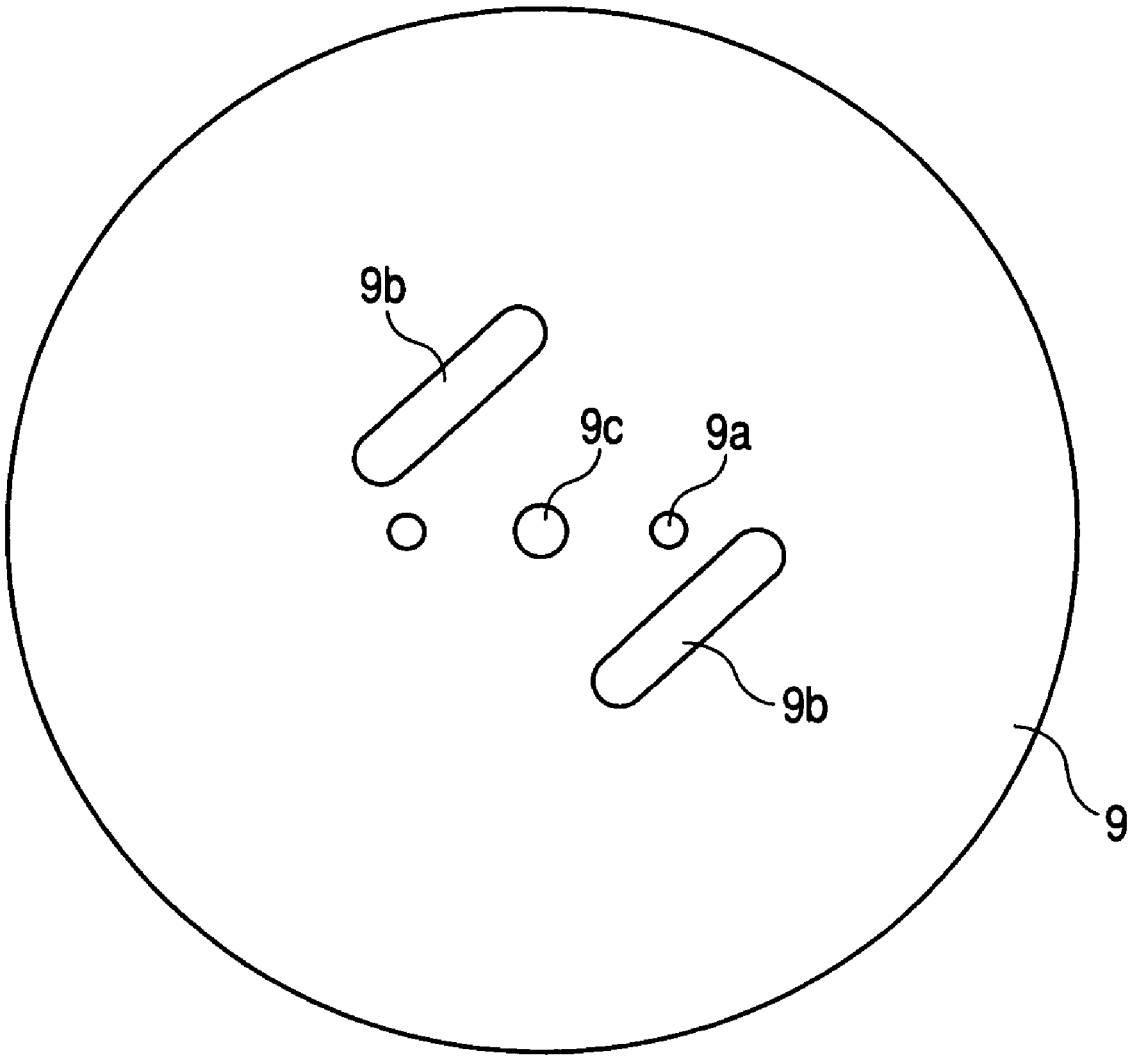
FIG. 14 is a bottom view of a valve housing according to the fifth embodiment.

Furthermore, the diaphragm pump according to the fifth embodiment has a configuration in which two diaphragm portions are disposed on a circumference at locations 180 degrees apart from each other as shown in FIGS. 11 and 12. The suction valves are disposed 180 degrees apart from each other at middle locations between both the diaphragm portions. In other words, two diaphragm portions 11*a* (pump chambers 12) are disposed so as to be at right and left side locations symmetrical with regard to an extension line of the output shaft 2 of the motor 1 as shown in FIG. 13. Furthermore, fifth embodiment has a configuration in which two suction valves (either shown in FIGS. 24E-I and 24E-II) are disposed at the upper and lower locations symmetrical with regard to an extension line of the output shaft 2 of the motor 1 as shown in FIG. 13 which is the sectional view taken in the direction perpendicular to the paper surface. Furthermore, the valve housing 9 has a bottom surface shown in FIG. 14 in which two vent holes 9*a* and two grooves 9*b* are formed.

Figure 15:
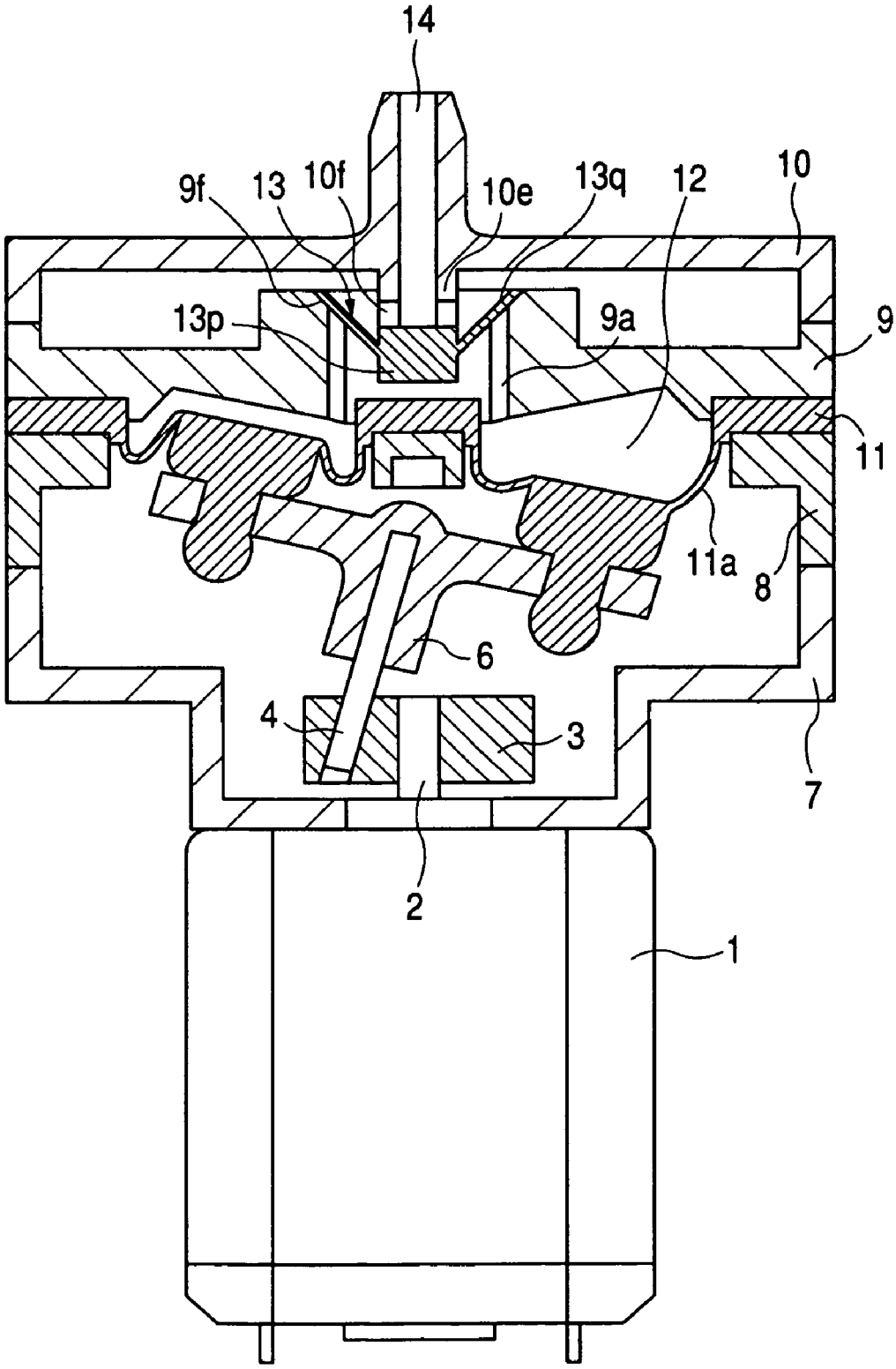
FIG. 15 is a sectional view showing a sixth embodiment of the present invention.

FIG. 15 is a diagram illustrating a sixth embodiment of the diaphragm pump according to the present invention.

A diaphragm pump according to the sixth embodiment is different from the pump according to the fifth embodiment in that the pump according to the sixth embodiment uses a discharge valve 13 having a V shaped section which has no mounting portion and a valve clamp portion 10*a* which is formed at a root of a discharge port 14 of an air collecting body (cover body) 10.

The diaphragm pump according to the sixth embodiment is different from the pump according to the fifth embodiment in mounting of the discharge valve in a valve housing and configured to be assembled more easily.

In FIG. 15, a reference numeral 1 represents a motor, a reference numeral 2 designates an output shaft of the motor, 1, a reference numeral 3 denotes a crank base, a reference numeral 4 represents a driving shaft which is attached to the crank base 3, a reference numeral 6 designates a driving body which is slidably attached to the driving shaft 4, a reference numeral 7 denotes a case, a reference numeral 8 represents a cylinder member, a reference numeral 9 designates a valve housing, a reference numeral 10 denotes an air collecting body (cover body), a reference numeral 11 represents a diaphragm main body which has a diaphragm portion 11*a*, a reference numeral 12 designates pump chamber and a reference numeral 13 denotes a conical discharge valve (having a V-shaped section): these parts being substantially the same as those of the pump according to the fifth embodiment shown in FIG. 11, except for a clamp portion 10*e* of the air collecting body 10 and a fixing portion 13*p* of the discharge valve which are configured differently.

In addition, a reference numeral 10*b* represents an air vent formed in the clamp portion of the air collecting body 10.

The diaphragm pump according to the sixth embodiment is different in that the discharge valve 13 is configured in a simple form which has only a central fixing portion 13*p* with no mounting portion (protrusion) 13*b* and that the air collecting body 10 has a clamp portion 10*e* which presses the fixing portion 13*p* of the discharge valve 13 to the air collecting body 10 for holding and fixing the discharge valve.

In addition, a reference numeral 10*f* represents a hole formed in the clamp portion 10*e*.

In addition, the suction valve has a configuration which is substantially the same as that in the pump according to the fifth embodiment.

Specifically speaking, the diaphragm pump according to the sixth embodiment is configured to sandwich and hold a diaphragm main body 11 between the cylinder member 8 and the valve housing 9, dispose the discharge valve 13 having the V-shaped section in a V shaped concave portion 9*f* of the valve housing 9 and fix the air collecting body 10 to the valve housing 9. The discharge valve 13 having the V-shaped section is fixed so as not to move by pressing a fixing portion 13*c* at a center of the discharge valve 13 having the V-shaped section with a valve clamp (clamp portion) 10*e* which is disposed at a center portion of the air collecting body 10 and extends downward.

The diaphragm pump according to the sixth embodiment has a configuration which is different only in a method to fix the discharge valve described above and the same as that of the diaphragm pump according to the fifth embodiment in other respects. Furthermore, the diaphragm pump according to the sixth embodiment has functions which are the same as those of the diaphragm pump according to the fifth embodiment.

Since the diaphragm pump according to the sixth embodiment is different in the method to fix the discharge valve 13 from the diaphragm pump according to the fifth embodiment as described above, the diaphragm pump according to the sixth embodiment is assembled by a method which is slightly different. A method desirable for assembling the diaphragm pump according to the sixth embodiment is to dispose the discharge valve 13 in a concave portion 9*f* of the valve housing 9, and integrate the valve housing 9 with the air collecting body 10 by fixing these parts to each other. At this stage, the air collecting body 10 is disposed to hold the discharge valve 13 securely at a predetermined position in the concave portion 9*f* of the valve housing 9. The diaphragm main body 11 is assembled so as to be sandwiched between the cylinder member 8 and an assembly which consists of the valve housing 9 and the air collecting body 10 integrated with each other.

Figure 16:
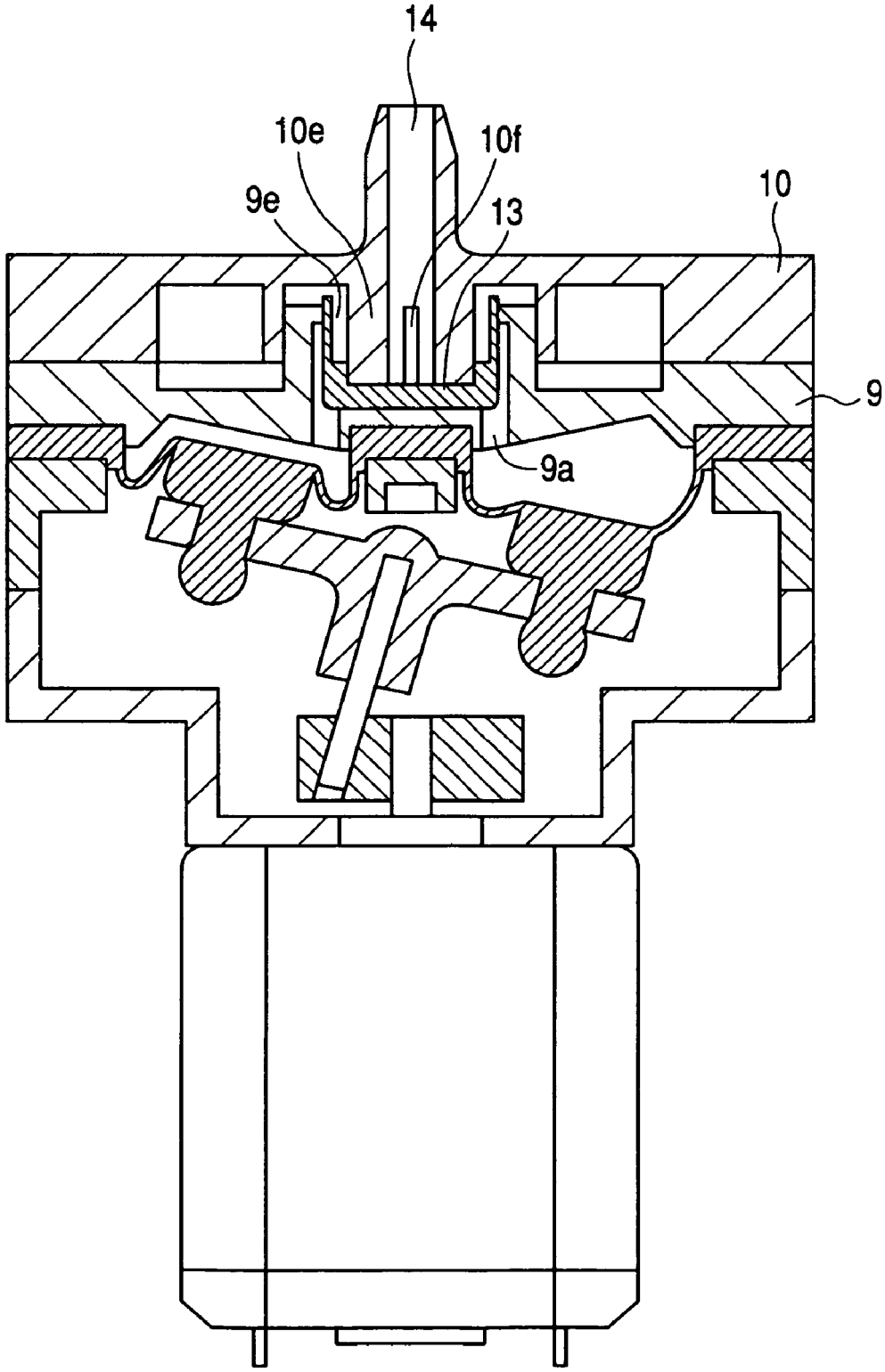
FIG. 16 is a sectional view showing a seventh embodiment of the present invention.

Now, FIG. 16 is a diagram illustrating a seventh embodiment of the diaphragm pump according to the present invention.

The diaphragm pump according to the seventh embodiment uses a discharge valve 13 which has a U-shaped section and a valve housing 9 which has a concave portion 9*e* having the same U-shaped section, therefore being different from the diaphragm pump according to the fifth or sixth embodiment.

In the seventh embodiment, the discharge valve 13 having the U-shaped section is disposed in the concave portion 9*e* having the U-shaped section of the valve housing 9. Then, an air collecting body 10 is attached to the valve housing 9, thereby pressing and fixing the discharge valve 13 with a valve clamp 10*e* of the air collecting body 10.

Each of the diaphragm pumps according to the above described fifth, sixth and seventh embodiments of the present invention is configured to have two diaphragm portions (two pump chambers). However, a diaphragm pump which has three or more diaphragm portions (pump chambers) like that according to the first, second or third embodiment may be adequately configured to have diaphragm portions disposed at equal internals on a circumference around a center of the pump. Arrangement of paths and grooves to be disposed in a valve housing as well as that of suction valves and the like to be formed in a diaphragm main body may be modified in conjunction with disposed locations of the diaphragm portions.

Figure 17:
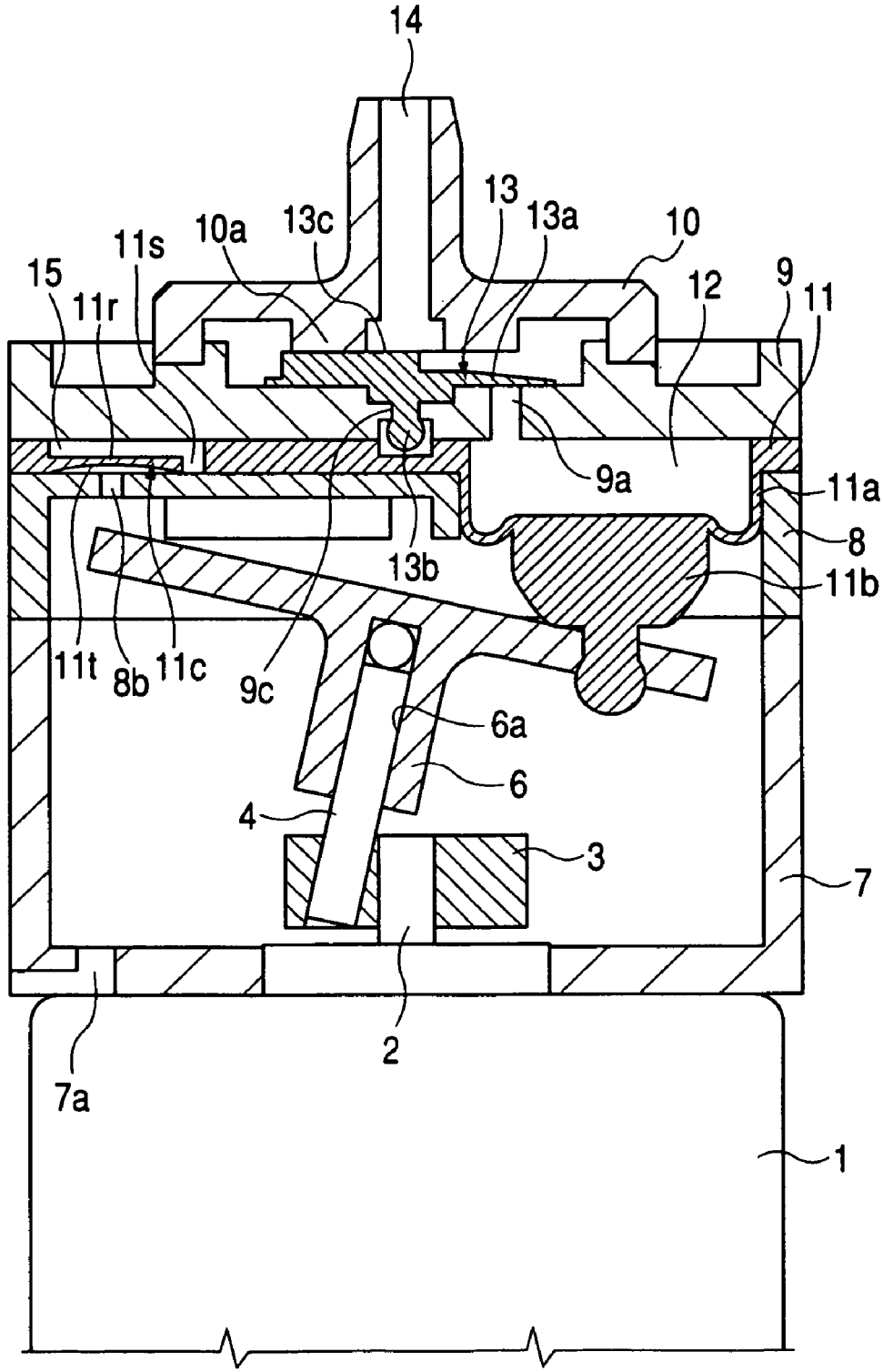
FIG. 17 is a sectional view showing an eighth embodiment of the present invention.

A configuration of a diaphragm pump according to an eighth embodiment of the present invention is illustrated in FIG. 17, in which a reference numeral 1 represents a motor, a reference numeral 2 designates an output shaft of the motor 1, a reference numeral 3 denotes a crank base which is fixed to the output shaft 2, a reference numeral 4 represents a driving shaft which is fixed to the crank base 3 in a condition inclined relative to the output shaft 2 and a reference numeral 6 designates a driving body which is rotatably attached to the driving shaft 4 by inserting the driving shaft 4 into a bearing portion 6*a* of the driving body 6. A reference numeral 7 denotes a case which has an air vent 7*a*, a reference numeral 8 represents a cylinder member, a reference numeral 9 designates a valve housing, a reference numeral 10 denotes an air collecting body, a reference numeral 11 represents a diaphragm main body which has a diaphragm portion 11*a* held by the cylinder member 8 and the valve housing 9, a reference numeral 12 designates a pump chamber, a reference numeral 13 denotes a discharge valve which is attached to the valve housing 9 and a reference numeral 14 represents a discharge port. The above described parts assembly is the same as that in the first embodiment shown in FIG. 2. The eighth embodiment is similar in a fundamental configuration to the first embodiment shown in FIG. 2 as described above, but different in a diaphragm main body 11, in a composition of a suction valve in particular, which is described below.

Figure 18A:
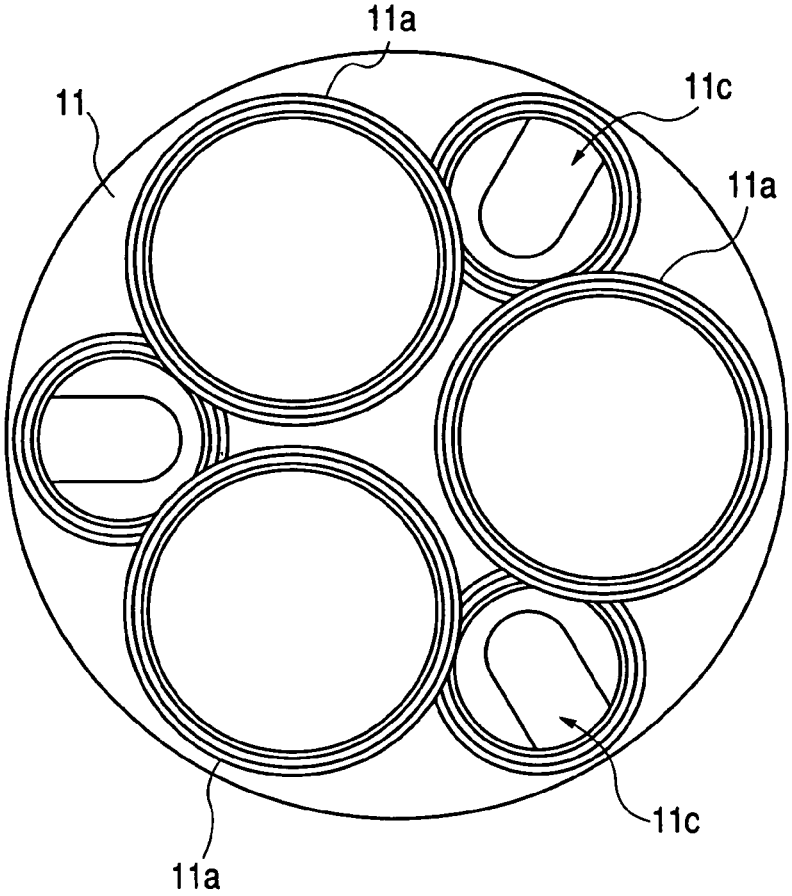
FIGS. 18A and 18B are diagrams showing a configuration of a diaphragm main body according to the eighth embodiment.
Figure 18B:
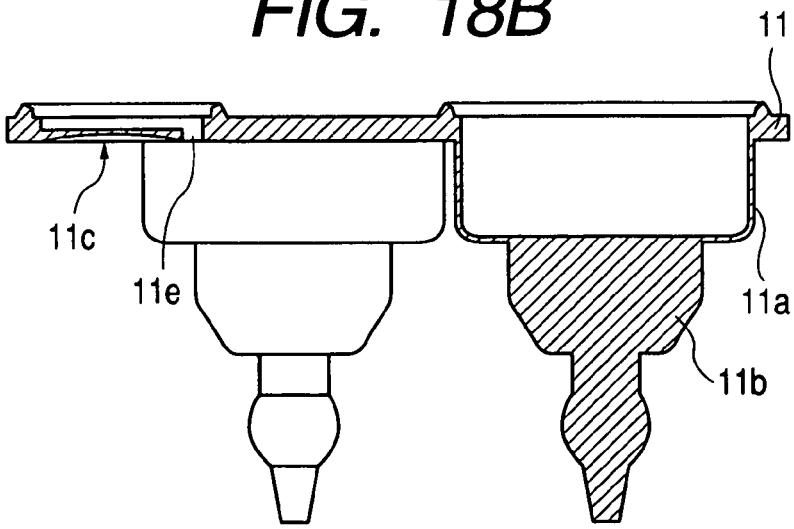
Figure 19A:
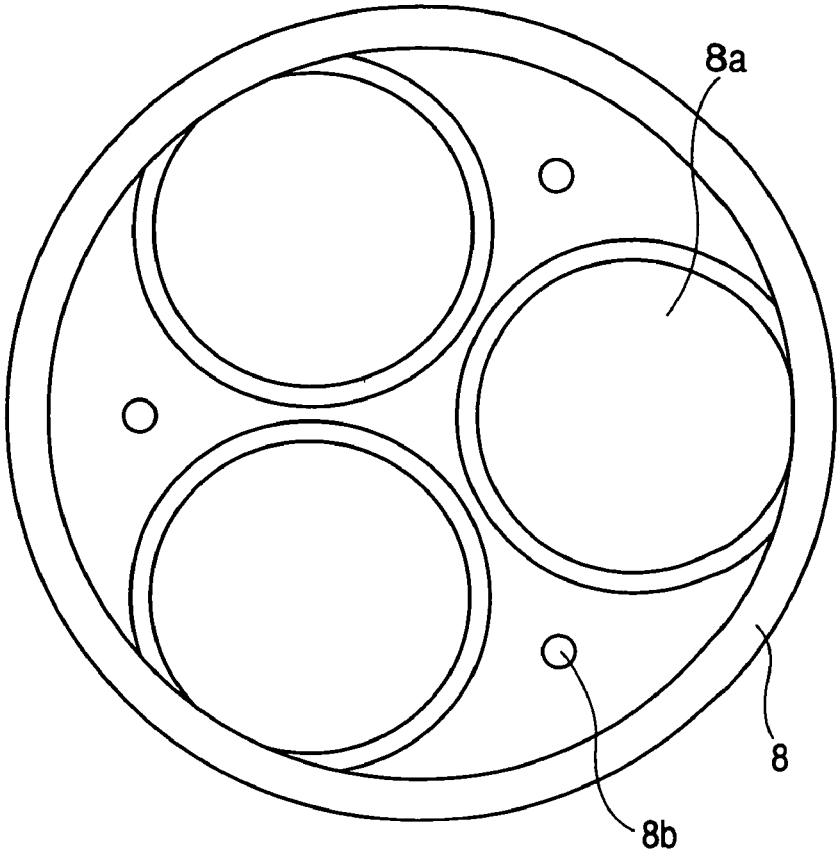
FIGS. 19A and 19B are diagrams showing a configuration of a cylinder portion according to the eighth embodiment.
Figure 19B:
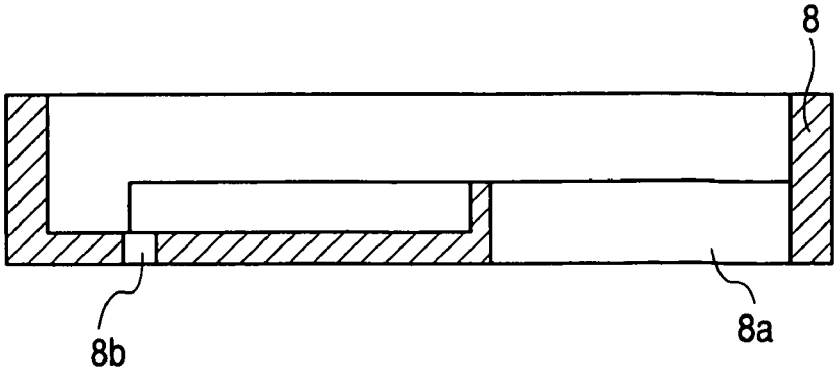

In the eighth embodiment, the diaphragm main body 11 is configured as shown in FIGS. 18A and 18B which are a plan view and a side view (sectional view) respectively. A form of the cylinder member 8 is shown in FIGS. 19A and 19B which are a plan view and a sectional view respectively. In addition, the valve housing 9 and the air collecting body 10 are substantially the same as those of the diaphragm pump according to the first embodiment which are illustrated in FIG. 5 and FIGS. 6A, 6B respectively. Furthermore, used as the discharge valve 13 is a valve shown in FIGS. 23A-I and 23A-II which is the same as that used in the first embodiment.

Now, detailed description will be made of parts which compose the diaphragm pump according to the eighth embodiment and an overall configuration of these parts in an assembled condition.

First, the diaphragm main body 11 has a configuration illustrated in FIGS. 18A and 18B which consists of a plurality of diaphragm portions 11*a* (the diaphragm main body shown in FIGS. 18A and 18B consists of three diaphragm portions disposed at equal intervals along a circumference as shown in the plan view presented as FIG. 18A) and three thin planar suction valves 11*c* formed among these diaphragm portion 11*a*. The suction valve used in the eighth embodiment has a form which is shown in FIGS. 24F-I and 24F-II. In other words, this suction valve is configured to have a thin valve portion 11*r* which extends into a circular opening 11*s* from a planar portion of the diaphragm main body 11 as shown in FIGS. 17, 24F-I and 24F-II. The suction valve is further configured to have a concave portion 11*t* having a gently curved surface 11*t* which is formed in a bottom surface of the valve portion 11*r* and a circular portion around the curved surface which is to be brought into close contact with a surface the cylinder member 8 on a side of the diaphragm main body. The valve is closed in a condition where a circumferential portion of the thin valve portion 11*r* is kept in close contact with a surface of the cylinder member 8, whereas the valve is opened when the circumferential portion is apart from the surface of the cylinder member 8. The diaphragm main body 11 is held by the cylinder member 8 and the valve housing 9 as shown in FIG. 17.

Furthermore, formed in the cylinder member 8 are holes (suction ports) 8*b* as shown in FIGS. 19A and 19B among cylinders 8*a* in which diaphragm portions 8*a* are to be disposed.

Furthermore, the valve housing 9 has a form which is substantially the same as that shown in FIG. 5, and has air vents 9*a*, groves 9*b* and a valve mounting hole 9*c*.

Furthermore, the discharge valve used in the diaphragm pump according to the eighth embodiment is the same as that in the first embodiment as described above, and has ribs 13*c* which extend in three directions from a center as shown in FIGS. 23A-I and 23A-II as well as sections composing valves among the ribs. In addition, a reference numeral 13 represents la convex portion (fixed portion).

Furthermore, formed in the cylinder member 8 are holes (suction ports) 8*b* as shown in FIGS. 19A and 19B among cylinders 8*a* in which diaphragm portions 11*a* are to be disposed.

After the diaphragm main body 11 is held as described above, the discharge valve 13 is set by pressing the convex portion 13*b* into the valve mounting hole 9*c* of the valve housing 9 and the air collecting body 10 having the discharge port 14 is attached or integrated to or with the valve housing 9. An assembly of the valve housing 9, the discharge valve 13 and the air collecting body 10 is attached to an assembly of the case 7, the cylinder member 8 and the diaphragm main body 11.

The diaphragm pump according to the eighth embodiment of the present invention illustrated in FIG. 17 is assembled as described above.

When the motor 1 is driven, the diaphragm pump according to the eighth embodiment also rotates the output shaft 2, thereby rotating the crank base which is fixed to the output shaft 2. Accordingly, the driving shaft 4 changes its direction of inclination and a direction of inclination of the driving body 6, thereby moving up and down the driving portion 11*b* of the diaphragm portion 11*a* like that of the conventional pump.

A capacity of the pump chamber 12 is changed when the driving portion 11*b* is moved up and down. When the driving portion 11*b* is raised higher than a position shown in FIG. 17, the capacity of the pump chamber 12 is reduced and a pressure is enhanced, whereby a fluid opens the discharge valve 13 (the valve portion 13*a* between the ribs 13*c* shown in FIG. 23A-I), passes between the ribs 13*c*, flows through a gap between the air collecting body 10 and the valve housing, and is supplied outside from the discharge port 14. At this time discharge valves corresponding to other diaphragm portions are closed.

When the driving portion 11*b* of the diaphragm portion 11*a* on the right side in FIG. 17 is lowered and the capacity of the pump chamber 12 is increased, the pressure is lowered in the pump chamber 12 and the discharge valve 13 is closed. Reversely, a pressure is lowered in a space 15 and the valve portion 11*r* of the thin planar portion (suction valve) 11*c* of the diaphragm main body (suction valve) is opened, whereby a fluid reserved in the cylinder member 8 and the case 7 flows from the suction port 8*b* of the cylinder member 8 into the diaphragm portion through the groove 9*b* of the valve housing 9 shown in FIG. 4. At this time, a fluid flows from outside into the case 7 through the air vent 7*a* formed in the case 7. Accordingly, a space formed by the case 7, the cylinder member 8 and the like is always filled with air.

The pumping chamber successively flows the fluid into and out of the pump chamber by repeating the above described operations, thereby performing a pumping action.

Furthermore, the other diaphragm portions (pump chambers) also perform pumping actions by quite the same operations. Moreover, the pump shown in FIG. 17 which uses a driving mechanism configured as described above continuously changes the direction of inclination of the driving body and supplies the fluid nearly continuously by operating the diaphragm portions with a definite phase difference.

The diaphragm pump according to the eighth embodiment of the present invention uses a suction valve configured to have a concave portion 11*t* which is formed at least in a surface of a thin valve portion on a side to be brought into contact with a cylinder portion as shown in FIGS. 24F-I and 24F-II. Accordingly, the suction valve is configured so that only a marginal portion of the thin valve portion which surrounds the concave portion is to be brought into contact with a surface of the suction port at a location which surrounds the suction port of the cylinder member. When the suction valve is closed, the valve therefore completely shuts up the suction port which is formed in the cylinder member, thereby being capable of opening and closing without fail. Furthermore, the suction valve is partically brought into contact with the surface of the cylinder member only around the concave portion, thereby being capable of preventing noise from being produced.

As a discharge valve of the diaphragm pump according to the eighth embodiment of the present invention, it is conceivable to use the valve shown in FIGS. 23B-I and 23B-II, FIGS. 23C-I and 23C-II or FIGS. 23D-I and 23D-II in addition to that shown in FIG. 23A-I and 23A-II.

As a suction valve of the diaphragm pump according to the eighth embodiment of the present invention, it is conceivable to use one of valves having various forms, that is, valves shown in FIGS. 24G-I and 24G-II, and FIGS. 24C-I and 24C-II in addition to that shown in FIGS. 24F-I and 24F-II.

The suction valve shown in FIGS. 24G-I and 24G-II consists of a circular opening 11*i*, a circular portion 11*u* (valve portion) for closing the suction port and having a diameter smaller than that of the opening and a thin portion consisting of a holding portion 11*v* extending in a vertical direction in the drawing from the circular portion 11*u* which are formed on the planar portion of diaphragm main body 11. Furthermore, a reference numeral 11*w* represents an arc-like opening which is formed between the opening 11*i* and the thin portion 11*u* composing the valve. This suction vale also has a form which has the concave portion lit formed in a surface of the a valve portion to be brought into contact with the surface of the cylinder member.

The suction valve shown in FIGS. 24C-I and 24C-II is configured so as to have a thin valve composing circular portion 11*f* which is held by three holding portions 11*g* and serves for closing the air vent formed in the cylinder member, and a gap (opening) which is formed around the thin portion. A valve portion of the suction valve shown in FIGS. 24C-I and 24C-II has a form which is curved as a whole so as to be concave on a side of the cylinder member. Accordingly, the suction valve has a concave portion 11*f* at least on the side of the cylinder member and is configured to be bought into contact with the surface of the cylinder member at a circumference around this concave portion. This valve therefore provides an effect to prevent noise from being produced at an opening time and a closing time of the valve like the suction valve according to the eighth embodiment of the present invention.

Now, description will be made of a ninth embodiment of the diaphragm pump according to the present invention.

Figure 20:
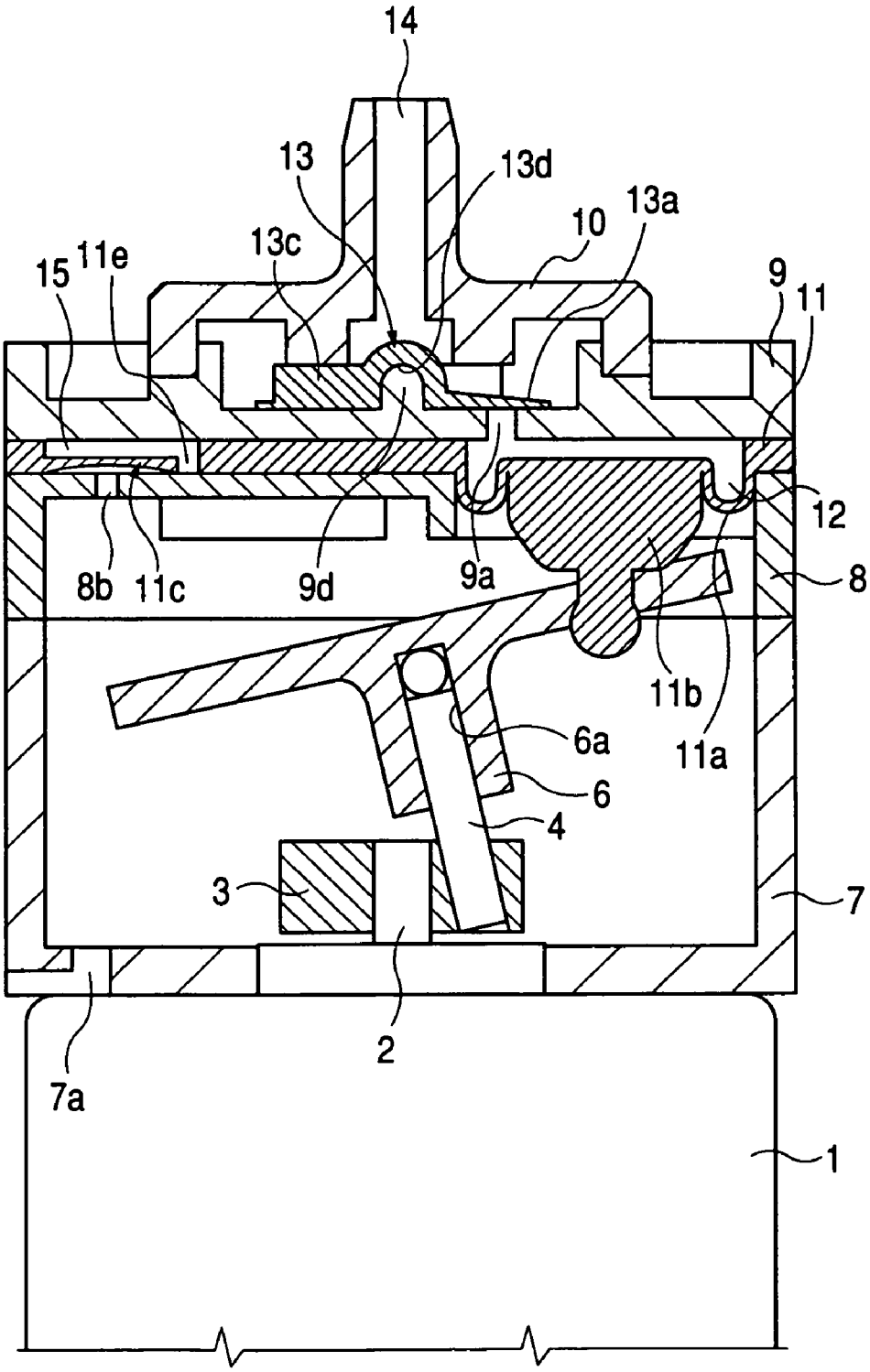
FIG. 20 is a sectional view showing a ninth embodiment of the present invention.

The ninth embodiment of the present invention is a diaphragm pump which has a configuration shown in FIG. 20, uses a discharge valve configured as shown in FIGS. 23B-I and 23B-II, and is similar in the configuration to the second embodiment illustrated in FIG. 7. Furthermore, the ninth embodiment uses a suction valve which is the same as that of the eighth embodiment and shown in FIGS. 24F-I and 24F-II.

Figure 21A:
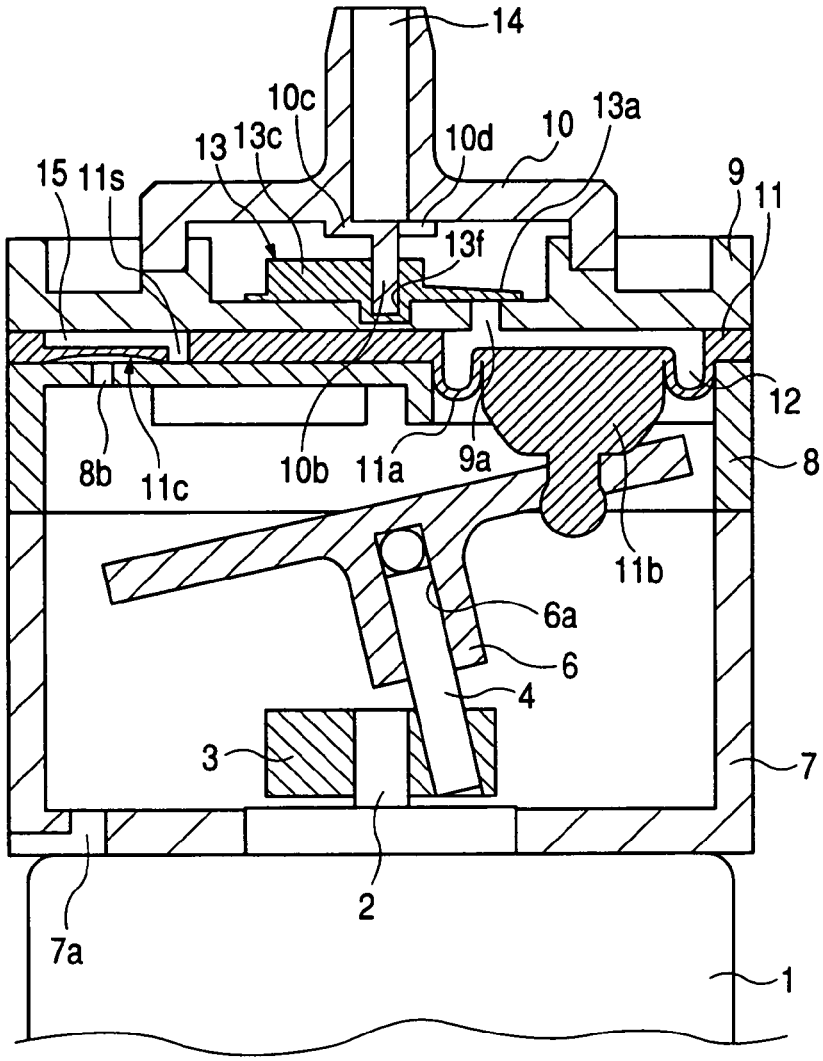
FIGS. 21A, 21B and 22 are diagrams showing a configuration of a tenth embodiment of the present invention.
Figure 21B:
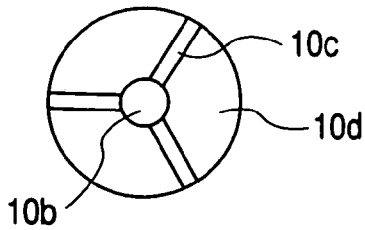

FIGS. 21A and 21B are diagrams illustrating a tenth embodiment of the present invention.

A diaphragm pump according to the tenth embodiment uses a discharge valve 13 which is configured to have a fixing portion 13*f* formed at a center portion as shown in FIGS. 23E-I and 23E-II for pressing and fixing the valve, three ribs 13*c* radially extending from the fixing portion 13*f* and a thin portion between adjacent ribs 13*c* for composing a valve 13*a* corresponding to each pump chamber 12. Furthermore, used as a suction valve 14 is the valve which is used in the eighth and ninth embodiments, and shown in FIGS. 24F-I and 24F-II.

Figure 22:
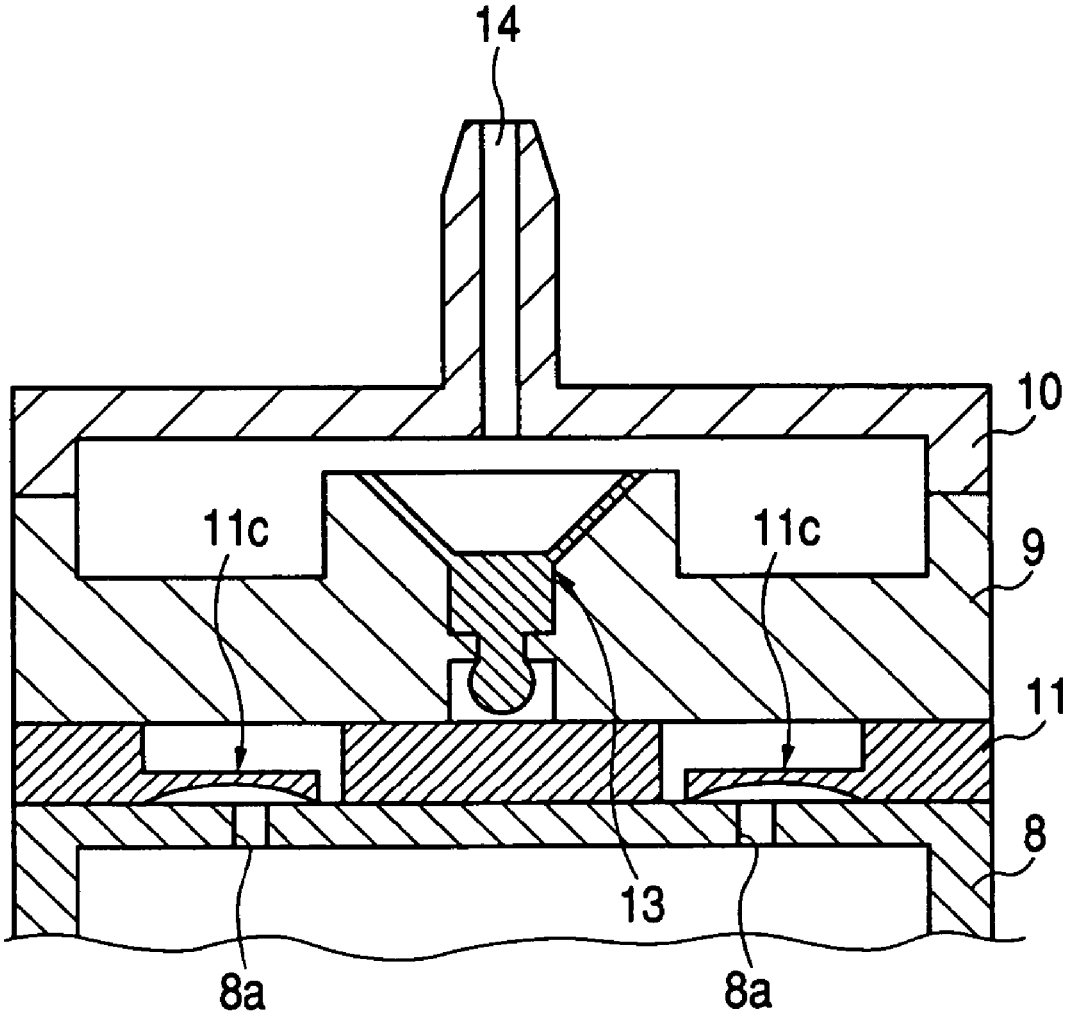

FIG. 22 shows a diaphragm pump having a configuration which is the same as that shown in FIG. 11, except for the suction valve which is replaced with the suction valve shown in FIGS. 24F-I and 24F-II. FIG. 22 is a sectional view taken in a direction perpendicular to the paper surface.

It is possible also for the diaphragm pumps shown in FIGS. 15 and 16 to use the suction valve shown in FIGS. 24F-I and 24F-II.

All of the diaphragm pumps according to the above described eighth, ninth and tenth embodiments are the same in fundamental configurations as the pumps according to the first, second and fourth embodiments (embodiments illustrated in FIGS. 2, 7, 10A and 10B) respectively. The diaphragm pumps according to eighth, ninth and tenth embodiments are different in a configuration of the diaphragm main body from the first, second and fourth embodiments. In other words, the eighth, ninth and tenth embodiments are characterized in that the diaphragm main body has the suction valve shown in FIGS. 24F-I and 24F-II.

Furthermore, it is possible for the diaphragm pumps shown in FIGS. 11, 12 and 15 which use the V shaped discharge valves having the V shaped discharge valve to use the suction valve shown in FIGS. 24F-I and 24F-II.

Though each of the above described first through tenth embodiments uses the driving mechanism having a configuration in which the bearing portion of the driving body is rotatably attached to the driving shaft 4 fixed to the crank base in an inclined condition, it is possible to reciprocate driving portions of a plurality of diaphragm portions at a definite phase difference as in the first, second and third embodiments, thereby performing a pumping action.

Furthermore, it is possible to use any driving mechanism other than that shown in FIG. 2 so far as the driving mechanism provides an equalled function, in other words, a driving mechanism is sufficiently usable so far as the mechanism can reciprocate the driving portion of the diaphragm portion, thereby changing the capacity of the pump chamber.

Furthermore, a location of the air vent formed in the case 7 is not limited to that shown in the drawing. That is, the diaphragm pump according to each of the above described embodiments is of a type which is used for supplying a gas or the like, or supplying air which flows into the case 7 through the above described air vent 7*a* from the discharge port by the above described operations. However, the diaphragm pump can be used for supplying a fluid such as a liquid other than the gas when a fluid inflow port is formed at an appropriate location.

Furthermore, though the diaphragms pump each having two or three diaphragm portions (pump chambers) are described as the embodiments, the present invention is applicable also to pumps each having four or more diaphragm portions (pump chambers). Similarly, the diaphragm pump according to the present invention can be configured so as to have a diaphragm portion (pump chamber).

Each of the suction valves shown in FIGS. 24C-I, 24C-II, 24F-I, 24F-II, 24G-I and 24G-II is characterized in that the spherical concave portion is formed in the surface on the side of the cylinder member. The suction valve which has the concave portion is characterized in that only the circular portion around the concave portion is brought into contact with the surface of the cylinder member and the valve prevents noise from being produced at the valve opening time and the valve closing time.

However, a suction valve is not limited to the valve having the spherical concave portion but sufficiently usable so far as the valve is configured to be brought into close contact with the surface of the cylinder member only at the portion surrounding a suction port formed in the cylinder member, thereby completely closing the suction port when the valve is closed.

Therefore, a suction valve may be a valve which has no concave portion in its surface on the side of the cylinder member and configured as described below.

A suction valve may have a planar surface on the side of the cylinder member and a slight protrusion along a line surrounding the suction port.

This valve is configured so that an opening 11*s* is formed around a thin portion (valve portion) 11*r*, the valve portion 11*r* has a planar surface on a side of a piston portion and a convex portion 11*x* protruding on a side of a piston portion is formed on this planar surface so as to surround a suction port formed in the diaphragm portion as shown in FIGS. 24H-I and 24H-II.

The invention claimed is:

1. Valves for a diaphragm pump comprising:

at least a diaphragm portion which forms a pump chamber;

a diaphragm main body which has a planar portion integrally connected to said diaphragm portion;

a suction valve which is formed at the planar portion of said diaphragm main body located between said diaphragm portions or in the vicinity of said diaphragm portion;

a discharge valve which has a V-shaped or U-shaped section; and a valve housing which has a concave portion having a V-shaped or U-shaped section and an air vent connecting a side surface of said concave portion to said diaphragm portion, wherein said discharge valve is disposed in close contact with the concave portion of said valve housing so as to be capable of opening and closing said air vent, and wherein said diaphragm portion has a driving portion and performs a pumping action by reciprocating said driving portion.

2. The valves for a diaphragm pump according to claim 1, wherein said discharge valve has a fixed portion, wherein said valve housing has a mounting hole, and wherein said discharge valve is fixed by pressing the fixed portion of said discharge valve into the mounting hole of said valve housing.

3. The valves for a diaphragm pump according to claim 1, further comprising an air collecting body which has a discharge port and a valve clamp, wherein said discharge valve is fixed by said valve clamp when said air collecting body is attached to said valve housing.

4. Valves for a diaphragm pump comprising:

a diaphragm main body which is connected definitely at a planar portion to at least a diaphragm portion forming a pump chamber;

a cylinder member having a cylinder into which said diaphragm portion is to be inserted and a suction port;

a suction valve having a portion which opens and closes the suction port at a location of the planar portion of said diaphragm main body; and a discharge valve, wherein said suction valve has a hole at a location different from that of said suction port, wherein said diaphragm portion has a driving portion and performs a pumping action by moving up and down said driving portion.

5. The valves for a diaphragm pump according to claim 4, wherein said suction valve has a valve portion and an opening at a portion surrounding the valve portion.

6. The valves for a diaphragm pump according to claim 9 or 5, wherein said discharge valve has a form of a planar plate.

7. The valves for a diaphragm pump according to claim 9 or 5, wherein said discharge valve has a U-shaped section.

8. The valves for a diaphragm pump according to claim 4, wherein the discharge valve defines a V-shaped or U-shaped section, wherein the valve housing defines a concave portion defining a V-shaped or U-shaped section and an air vent which connects a side surface of the concave portion to the pump chamber formed by the diaphragm portion, and wherein the discharge valve is disposed in close contact with the concave portion so as to be capable of opening and closing the air vent.

9. The valves for a diaphragm pump according to claim 3 or claim 8, wherein the discharge valve having the V-shaped or U-shaped section has a fixed portion at a center thereof, and wherein the valve clamp of the air collecting body is configured fix the discharge valve by clamping the fixed portion.

10. The valves for a diaphragm pump according to claim 3, further comprising an air hole formed in the valve clamp, the air hole providing communication between the discharge valve and the discharge port.

11. The valves for a diaphragm pump according to claim 9, further comprising an air hole formed in the valve clamp, the air hole providing communication between the discharge valve and the discharge port.

* * * * *